US007406291B2

(12) United States Patent
Manabe et al.

(10) Patent No.: US 7,406,291 B2
(45) Date of Patent: Jul. 29, 2008

(54) IMAGE READING FORMING APPARATUS HAVING A PLATEN ROLLER PRESSING A DOCUMENT AGAINST THE DOCUMENT GLASS STAND

(75) Inventors: Kenichi Manabe, Tokyo (JP); Kazuyuki Iwamoto, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 602 days.

(21) Appl. No.: 10/753,489

(22) Filed: Jan. 9, 2004

(65) Prior Publication Data

US 2004/0145785 A1 Jul. 29, 2004

(30) Foreign Application Priority Data

Jan. 15, 2003 (JP) ..... 2003-007611

(51) Int. Cl.
*G03G 15/00* (2006.01)

(52) U.S. Cl. ..... 399/367; 399/379; 399/380; 358/496; 358/497

(58) Field of Classification Search ..... 399/367, 399/379; 358/496, 497
See application file for complete search history.

(56) References Cited

U.S. PATENT DOCUMENTS

| | | | | | |
|---|---|---|---|---|---|
| 4,319,741 | A | | 3/1982 | Okamoto | 271/118 |
| 4,903,085 | A | * | 2/1990 | Ikeda et al. | 399/374 |
| 4,970,606 | A | * | 11/1990 | Shima | 358/474 |
| 5,001,520 | A | * | 3/1991 | Kawano et al. | 399/372 |
| 5,033,728 | A | * | 7/1991 | Miura et al. | 271/3.18 |
| 5,077,585 | A | * | 12/1991 | Watanabe et al. | 399/367 |
| 5,101,284 | A | * | 3/1992 | Tanabe | 358/461 |
| 5,154,412 | A | * | 10/1992 | Iseda | 271/227 |
| 5,634,635 | A | * | 6/1997 | Kobayashi et al. | 271/3.16 |
| 5,878,309 | A | * | 3/1999 | Nomura et al. | 399/111 |
| 6,055,070 | A | * | 4/2000 | Kang | 358/497 |

FOREIGN PATENT DOCUMENTS

| | | | |
|---|---|---|---|
| JP | 10293431 | A | 11/1998 |
| JP | 11088594 | A * | 3/1999 |
| JP | 2002-335371 | | 7/2006 |

* cited by examiner

*Primary Examiner*—Leslie J Evanisko
*Assistant Examiner*—Matthew G Marini
(74) *Attorney, Agent, or Firm*—Fitzpatrick, Cella, Harper & Scinto

(57) ABSTRACT

An image reading apparatus is provided with a document glass stand on which a document is placed, and a document feeding portion having a platen roller for feeding out the document fed into the reading position of the document glass stand from the reading position and a pressure plate having elasticity and capable of pressing the document placed on the document glass stand against the document glass stand with the platen roller, and openable and closable relative to the document glass stand. A document reading sensor reads the document placed on the document glass stand while being moved below the document glass stand, and reads the document fed into the reading position while being stopped at the reading position. Design is made such that after the document feeding portion is closed and the document has been pressed against the document glass stand by the pressure plate, the platen roller presses the document against the document glass stand.

8 Claims, 19 Drawing Sheets

IMAGE READING FORMING APPARATUS HAVING A PLATEN ROLLER PRESSING A DOCUMENT AGAINST THE DOCUMENT GLASS STAND

BACKGROUND OF THE INVENTION

1. Field of the Invention

The invention relates to an image reading apparatus for reading an image formed on a sheet, and particularly to an image reading apparatus for reading an image on a sheet without shifting the position of the sheet placed on a reading glass member, and an image forming apparatus provided with the image reading apparatus.

2. Description of Related Art

There has heretofore been an image forming apparatus provided with an image forming portion, an image reading portion and a document feeding apparatus or the like for supplying sheets (hereinafter referred to as the "documents" having images formed thereon one by one to the reading position of the image reading portion and discharging the documents after read to a document discharge stand, like a digital copying machine, a facsimile apparatus, a printer or a compound machine of these.

Image forming apparatus have heretofore included, for example, an image forming apparatus according to a first conventional example shown in FIGS. 9 to 12 of the accompanying drawings, and an image forming apparatus according to a second conventional example (e.g. Japanese Patent Application Laid-Open No. Hei 10-293431) shown in FIGS. 13 to 19 of the accompanying drawings.

(Image Forming Apparatus According to the First Conventional Example)

The image forming apparatus 100 according to the first conventional example is provided with an image forming portion 101, an image reading portion 102 and a document feeding portion 103. The image reading portion 102 and the document feeding portion 103 together constitute an image reading apparatus 120.

The image reading portion 102 is adapted to read an image by two methods, i.e., a "flow-reading mode" for fixing a reading sensor 104 at a predetermined position, and reading an image while transporting a sheet-like document P1 by the document feeding portion 103, and a "fixed-reading mode" for fixing a thick document such as a book on a document glass stand 105, and reading an image while moving the reading sensor 104 in the directions of double-headed arrow A.

The "flow-reading mode" will first be described. The documents P1 stacked on the document tray 106 of the document feeding portion 103 are fed out by a preliminary transport roller 107 and a preliminary transport pressure plate 108, are separated one by one by a separating piece 109 and a separating roller 110, and are transported to the reading position 113 of the image reading portion 102 by a pair of sheet feeding rollers 111 and 112. The document P1 transported to the reading position 113 is transported by a platen roller 114 while being brought into close contact with the document glass stand 105. At this time, the image reading portion 102 reads the image of the document P1 transported by the document feeding portion 103 by the reading sensor 104 stopped from moving at the reading position 113. The document P1 after read is discharged onto a document discharge tray 117 by a pair of sheet discharging rollers 115 and 116.

The "fixed-reading mode" will now be described. On the document glass stand 105, there is provided an index 118 which becomes placement indicating means when a document P2 is placed on the document glass stand 105 in the case of the "fixed-reading mode". The index 118 is disposed on the right of the reading position 113 during the flow reading. The document P2 is placed on the document glass stand 105 with its left end abutted against the index 118. The image reading portion 102 reads the document placed on the document glass stand 105 while the reading sensor 104 is moved in the directions of double-headed arrow A by a driving mechanism, not shown. The document P2 placed on the document glass stand 105 is pressed against the document glass stand 105 by the pressure plate 119 of the document feeding portion 103 so as not to float.

As described above, in the image forming apparatus according to the first conventional example, the position for reading the image differs between the "flow-reading mode" and the "fixed-reading mode". Accordingly, the image forming apparatus according to the first conventional example, as shown in FIG. 11, requires at a minimum a width corresponding to the length L1 of a document of a maximum size, plus an amount L2 corresponding to the width of the index 118 on the left side, plus an amount L3 corresponding to a width for securing the reading position 113 during the "flow-reading mode" further on the left thereof, and has been difficult in achieving the downsizing of the apparatus.

(The Image Forming Apparatus According to the Second Conventional Example)

So, like the image forming apparatus 200 according to the second conventional example shown in FIG. 13, there is one in which the reading position during the "flow-reading mode" is disposed on the right of the image reading portion. The image forming apparatus 200 according to the second conventional example is provided with an image forming portion A, an image reading portion B and a document feeding portion C. The image reading portion B and the document feeding portion C together constitute an image reading apparatus E.

This image reading portion B is also adapted to read a document by the fixed-reading mode and the flow-reading mode. The image reading portion B has a scanning rail 282 disposed toward the right and left on a frame 281. The image reading portion B is designed such that a document reading sensor 283, e.g. a contact image sensor (CIS) scans on the scanning rail 282 in parallelism to a document glass stand 284, and reads a documents set on the document glass stand 284 (the fixed-reading mode).

The image reading portion B has an abutment portion 280 against which the leading edge portion (left side) of the documents are abutted when the document is set on the document glass stand 284. Also, the image reading portion B is adapted to stop the document reading sensor 283 at a reading position D, and read the documents supplied one by one from a document stacking tray 252 by the document feeding portion C and moved on the reading position in a sub-scanning direction (the flow-reading mode).

Description will now be made of the construction of the document feeding portion C in the image reading apparatus according to the second conventional example.

FIG. 14 is a front cross-sectional view of the document feeding portion C.

The document feeding portion C has the document stacking tray 252 for stacking the documents thereon with the image bearing surfaces thereof facing downward, a pickup roller 203 at a location opposed to the documents, and a separating portion comprising a pad 204 and a separating roller 205 downstream thereof. The pickup roller 203 is rotatably provided on sheet feeding arms 219 and 220 (220 being not shown) pivotally provided on the rotation center shaft 201 of the separating roller 205. The pickup roller 203 is adapted to contact with the uppermost document (the last page) of the document stack placed with the images thereof facing downwardly.

Also, a document set sensor 244 is provided between the pickup roller 203 and the separating roller 205. The document set sensor is adapted to detect whether the documents are present on the document stacking tray 252. A pair of register rollers 206 and 207 are provided downstream of the separating roller 205. An ante-register sensor 245 is provided between the separating roller 205 and the pair of register rollers 206 and 207. The ante-register sensor 245 is provided to determine a transport amount for the separating roller 205 to transport the document to the pair of register rollers 206 and 207.

Downstream of the pair of register rollers 206 and 207, there is disposed a platen roller 208 for urging the document against the document glass stand 284 of the image reading portion B and at the same time, transporting the document. Downstream of the platen roller 208, there are disposed a pair of transporting rollers 209 and 210 for discharging the document on the document glass stand 284. Further downstream thereof, there are disposed a pair of sheet discharging rollers 211 and 212 for discharging the document to a discharge tray 218.

FIG. 15 is a top cross-sectional view of the image reading portion B and the document feeding portion C. As shown in FIG. 15, a hinge designated by the reference numeral 262 is provided leftwardly rearwardly of the image reading portion B and the document feeding portion C. A hinge denoted by the reference numeral 263 is rightwardly rearwardly of the image reading portion B and the document feeding portion C.

As shown in FIG. 16, the platen roller 208 has its front and rear ends mounted on pivotally movable arms 248 and 249, and are adapted to be rotated about the bearing portions 248*b* and 249*b* of the front and rear pivotally movable arms 248 and 249, respectively. The front and rear pivotally movable arms 248 and 249 are pivotally movable about the bearing portions 248*a* and 249*a*, respectively, and the opposite ends of the platen roller 208 are adapted to be independently pivotally moved with the pivotally movable arms 248 and 249. Also, the lowermost portions 248*c* and 249*c* (not shown) of the front and rear pivotally movable arms 248 and 249, respectively, are adapted to be reliably installed on the document glass stand 284.

Also, as shown in FIG. 14, the document feeding portion C has a pressure plate 255 for pressing the documents on the document glass stand 284 during the fixed-reading mode. The pressure plate 255 is comprised of an overlying elastic member 255*a* such as a sponge and an underlying white sheet portion 255*b* stuck on each other. When the document feeding portion C is closed, the white sheet portion 255*b* is installed on the documents on the document glass stand 284, whereafter the elastic member 255*a* is compressed until rubber feet 264, 265 and 266 are installed on the image reading portion B. Accordingly, the document on the document glass stand 284 is reliably pressed against the document glass stand 284 so as not to move from its placed position.

Also, the platen roller 208 is designed such that the front and rear ends thereof are independently grounded to the document glass stand 284 by the pivotally movable arms 248 and 249 and therefore, even if the grounded state of the document feeding portion C somewhat differs due to the dimensional error between respective mechanisms, the platen roller can be grounded to the document glass stand 284 in a constant state in the reading portion and therefore, it never happens that a fogged image is caused by the platen roller 208 floating from the document glass stand 284 more than a predetermined amount, and reading can be accomplished reliably.

In the above-described image forming apparatus 200 according to the second conventional example shown in FIG. 13, the reading position D is disposed on the right of the image reading portion B. Accordingly, the image forming apparatus 200 according to the second conventional example, unlike the image forming apparatus 100 according to the first conventional example, the abutment portion 280 can be disposed at the left end without the index 118 being disposed between the reading position during the flow-reading mode and the reading position during the fixed-reading mode and therefore, the document glass stand 284 can be made small.

Also, in the image forming apparatus 200 according to the second conventional example, as shown in FIG. 15, the document glass stand 284 is further downsized in such a manner that during the fixed-reading mode, the platen roller 208 presses the trailing edges of documents of a maximum size (LGL size in the present conventional example), thereby achieving the downsizing of the image reading portion B. Even if design is made such that the trailing edges of the LGL documents P2 (documents of the maximum size) are pressed not by the pressure plate 255 but by the platen roller 208, the platen roller 208 is pressed against the document glass stand 284 and therefore, the floating of the trailing edges of the LGL documents is prevented and a fogged image does not occur, and the reading of the documents can be accomplished reliably.

The platen roller 208, however, is designed such that the front and rear ends thereof are independently grounded to the document glass stand 284 by the pivotally movable arms 248 and 249 and therefore, when the document feeding portion C is opened, as shown in FIG. 17, the platen roller 208 is adapted to be pulled down from its broken-line position to its solid-line position by gravity and the pulling forces of biasing springs 253 and 254.

Also, in a state wherein the pressure plate 255 is closed, the elastic member 255*a* is compressed and crushed, but when the document feeding portion C is opened, the platen roller 208 is lowered to its solid-line position and becomes located by a distance "h" below the underside of the white sheet portion 255*b* of the pressure plate 255. When in this state, the LGL documents (of the maximum size) are placed and the document feeding portion C is closed, the platen roller 208 earlier contacts with the trailing edge portions (right end portions) of the LGL documents, whereafter the pressure plate 255 presses the documents.

When the documents are pressed against the document glass stand 284 by the pressure plate 255 (see FIG. 17) while the document feeding portion C is being closed as shown in FIG. 18, the pressure plate 255 comes into contact with the documents from the inner part thereof near to the hinges 262 and 263 which are the center of pivotal movement, whereafter the front side thereof comes into contact with the documents and therefore, before the front side (the pivotally movable arm 248) of the platen roller 208 contacts with the document glass stand 284, the pivotally movable arm 249 is pivotally moved in the direction indicated by the arrow Y, and when viewed from the front, is pivotally moved in the direction indicated by the arrow X indicated in FIG. 17. Accordingly, as shown in FIG. 19, the trailing edges of the documents of the maximum size positionally deviate in the direction indicated by the arrow X with the pivotal movement of the inner part of the platen roller 208.

The document feeding portion C is further closed and at a point of time whereat the pressure plate 255 has contacted with the documents, the pressure plate 255 presses the documents, which thus stop on the document glass stand 284 with their inner part deviated to the right. When at this document position, an image is read by the "fixed-reading mode", the documents are placed on the document glass stand 284 while being rotated by an angle α, and this also gives rise to the problem that an output image is rotated by the angle α.

Also, even in a construction wherein document abutting means is present on the inner side, the documents (particularly thin paper) are strongly urged against the document abutting means, and this has given rise to the problem that the documents are buckled or damaged and a faulty output image occurs.

SUMMARY OF THE INVENTION

The present invention has as its object to provide an image reading apparatus which is provided with a transporting rotary member for transporting a document when the document is to be flow-read, and urging the document against a reading position when the document is to be fixed-read, and is designed such that when the document is to be fixed-read, the position of the document is not deviated by the transporting rotary member, and of which the downsizing has been achieved.

In order to achieve the above object, the image reading apparatus of the present invention is provided with a reading glass member on which a document is placed, a document feeding portion having a transporting rotary member for feeding out the document fed into the reading position of the reading glass member from the reading position, and a presser member having elasticity and capable of pressing the document placed on the reading glass member against the reading glass member with the transporting rotary member, and openable and closable relative to the reading glass member, and reading means capable of reading the document placed on the reading glass member while being moved below the reading glass member, and reading the document fed into the reading position while being stopped at the reading position, and is designed such that after the document feeding portion is closed and the presser member has pressed the document against the reading glass member, the transporting rotary member presses the document against the reading glass member.

DESCRIPTION OF THE PREFERRED EMBODIMENTS

Figure 1:
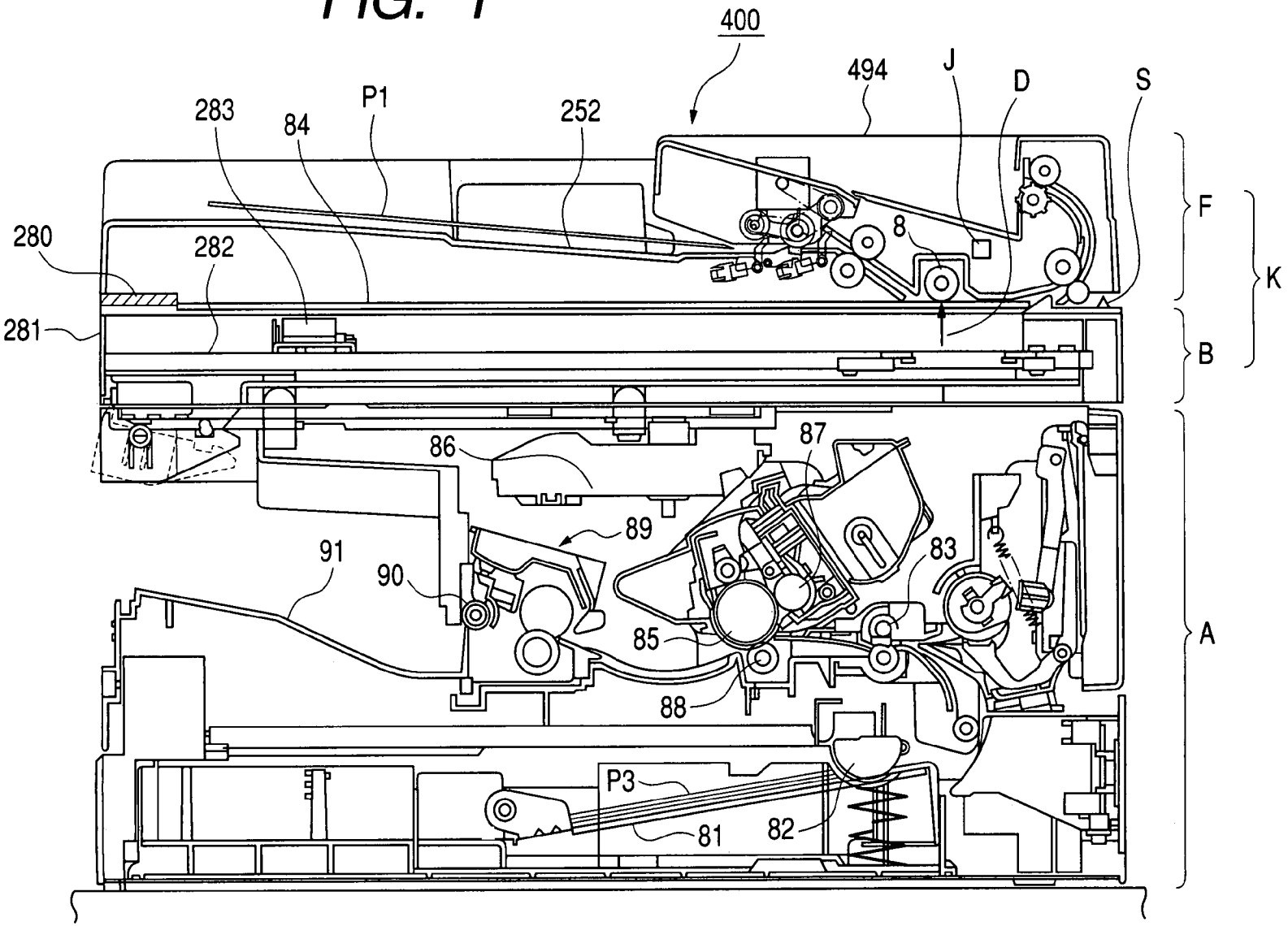
FIG. 1 is a schematic front cross-sectional view of an image forming apparatus provided with an image reading apparatus according to an embodiment of the present invention.

Image reading apparatuses according to some embodiments of the present invention will hereinafter be described with reference to the drawings.

Embodiments of the image reading apparatus of the present invention include two embodiments, i.e., a first embodiment and a second embodiment. Both of the image reading apparatuses according to the first embodiment and the second embodiment differ from the conventional image reading apparatus in the construction of portions around a platen roller. In the image reading apparatus of the present invention, portions similar to those in the conventional examples are given the same reference characters and will be described.

The image reading apparatus is adapted to read characters, a picture, a pattern and the like (hereinafter generically referred to as the "image") formed on a sheet. Sheets include plain paper, thin sheets made of resin, thick paper, postcards, sealed documents, paper for overhead project, etc. The image reading apparatus according to the present embodiment is adapted to read, for example, a document having an image formed on plain paper when in the flow-reading mode.

FIG. 1 is a cross-sectional view of an image forming apparatus provided with an image reading apparatus according to an embodiment of the present invention taken along a document transport direction.

The image forming apparatus 400 is provided with an image forming portion A, an image reading portion B, a document feeding portion F, etc. The image reading portion B and the document feeding portion F together constitute an image reading apparatus K. This image reading apparatus K is an image reading apparatus according to the first embodiment.

(Image Forming Portion A of the Image Forming Apparatus 400)

In FIG. 1, the image forming portion A is a portion for forming an image on a recording material P3.

A pickup roller 82 feeds out the recording material P3 placed on the tilting plate 81 of a cassette. A pair of register rollers 83, when in a state in which they are stopped from rotating, receive the leading edge of the recording material P3. On the other hand, a latent image is formed on a photosensitive drum 85 by a laser scanner 86, and a toner image is formed thereon by a developing device 87.

The pair of register rollers 83 are started in accordance with the position of the toner image on the photosensitive drum 85, and feed the recording material P3 into between the photosensitive drum 85 and a transferring device 88. The transferring device 88 transfers the toner image to the recording material P3. A fixing device 89 heats and pressurizes the recording material P3 and fixes the toner image on the recording material. Lastly, a pair of discharge rollers 90 discharge the recording material having the toner image fixed thereon onto a discharge tray 91.

Image Reading Apparatus K According to the First Embodiment in the Image Forming Apparatus 400

The image reading apparatus K according to the first embodiment is comprised of an image reading portion B and a document feeding portion F.

(Image Reading Portion B)

The image reading portion B shown in FIG. 1 is adapted to read a document P1 by the fixed-reading mode and the flow-reading mode. The image reading portion B has a scanning rail 282 disposed toward the right and left on a frame 281. The image reading portion B is designed such that a document reading sensor 283, e.g. a contact image sensor (CIS), which is reading means, scans on the scanning rail 282 in parallelism to a document glass stand 84 which is a reading glass member, and reads the document set on the document glass stand 84 (fixed-reading mode).

The image reading portion B has, for example, an abutment portion 280 which is receiving means against which the leading edge portion (the left side) of the documents is abutted when the documents are set on the document glass stand 84. Also, the image reading portion B is adapted to stop the document reading sensor 283 at a reading position D, and read the documents supplied one by one from a document stacking tray 252 by the document feeding portion F and moved on the reading position D in a sub-scanning direction (the flow-reading mode).

(Document Feeding Portion F)

Figure 2:
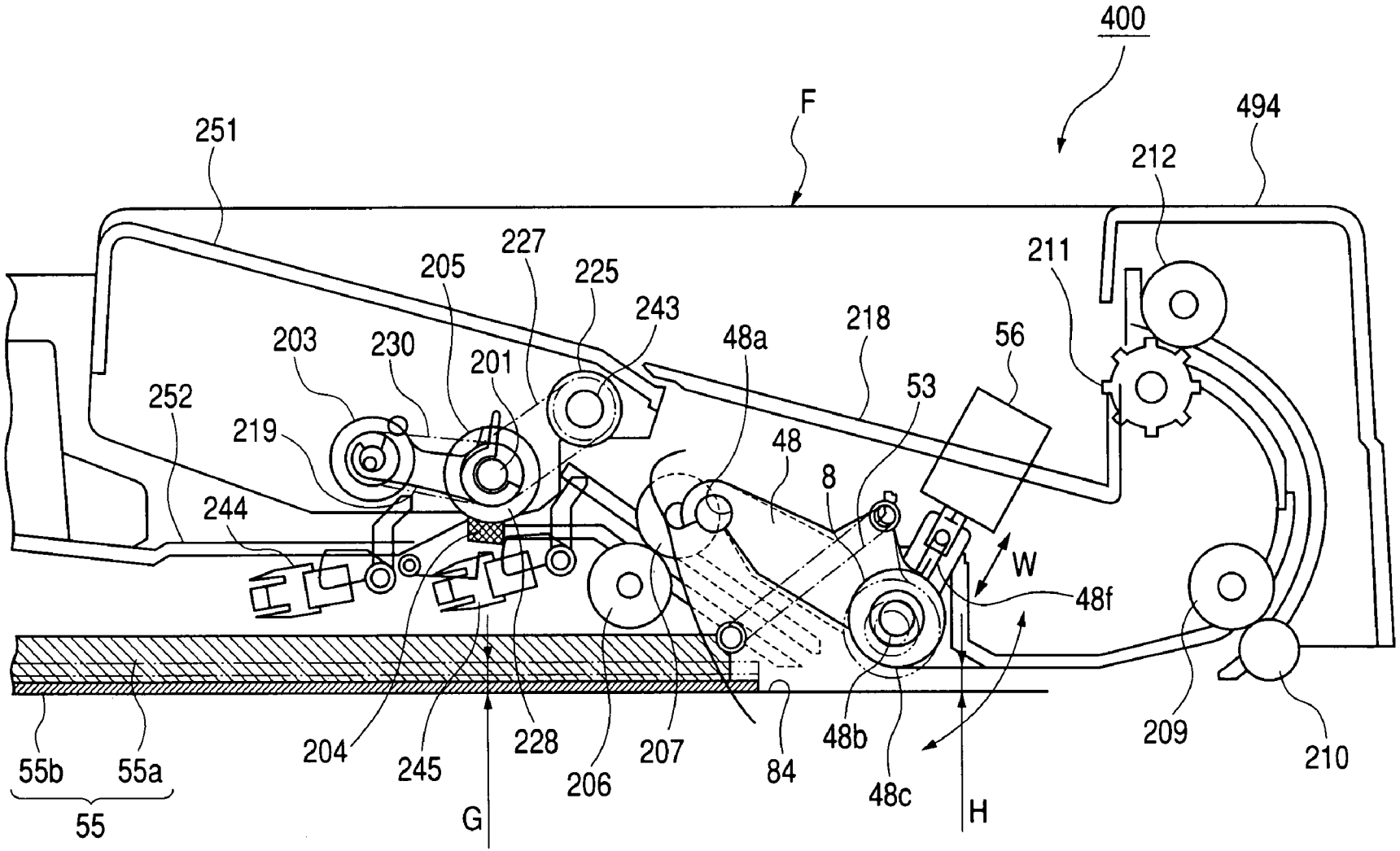
FIG. 2 is a cross-sectional view of an image reading apparatus according to a first embodiment of the present invention taken along a document transport direction.

FIG. 2 is a front cross-sectional view of the document feeding portion F. For example, the document feeding portion F which is a sheet feeding portion is contained in a frame 494. The document feeding portion F has the document tracking tray 252 on which the documents are placed with the image bearing surfaces thereof facing downwardly, a pickup roller 203 disposed at a location opposed to the documents, and a separating portion comprising a pad 204 and a separating roller 205 disposed downstream thereof. The pickup roller 203 is rotatably provided on sheet feeding arms 219 and 220 (220 being not shown) pivotally provided on the rotation center shaft 201 of the separating roller 205. The pickup roller 203 is adapted to contact with the uppermost document (the last page) of a document stack placed with the images thereof facing downwardly.

Also, a document set sensor 244 is provided between the pickup roller 203 and the separating roller 205. The document set sensor 244 is adapted to detect whether the documents are present on the document stacking tray 252. A pair of register rollers 206 and 207 are provided downstream of the separating roller 205. An ante-register sensor 245 is provided between the separating roller 205 and the pair of register rollers 206 and 207. The ante-register sensor 245 is provided to determine a transport amount for the separating roller 205 to transport the document to the pair of register rollers 206 and 207.

Downstream of the pair of register rollers 206 and 207, there is disposed a platen roller 8 which is a transporting rotary member for urging the documents against the document glass stand 84 of the image reading portion B and at the same time, transporting the documents. Downstream of the platen roller 8, there are disposed a pair of transport rollers 209 and 210 for discharging the documents on the document glass stand 84. Further downstream thereof, there are disposed a pair of discharge rollers 211 and 212 for discharging the documents onto a discharge tray 218.

Figure 3:
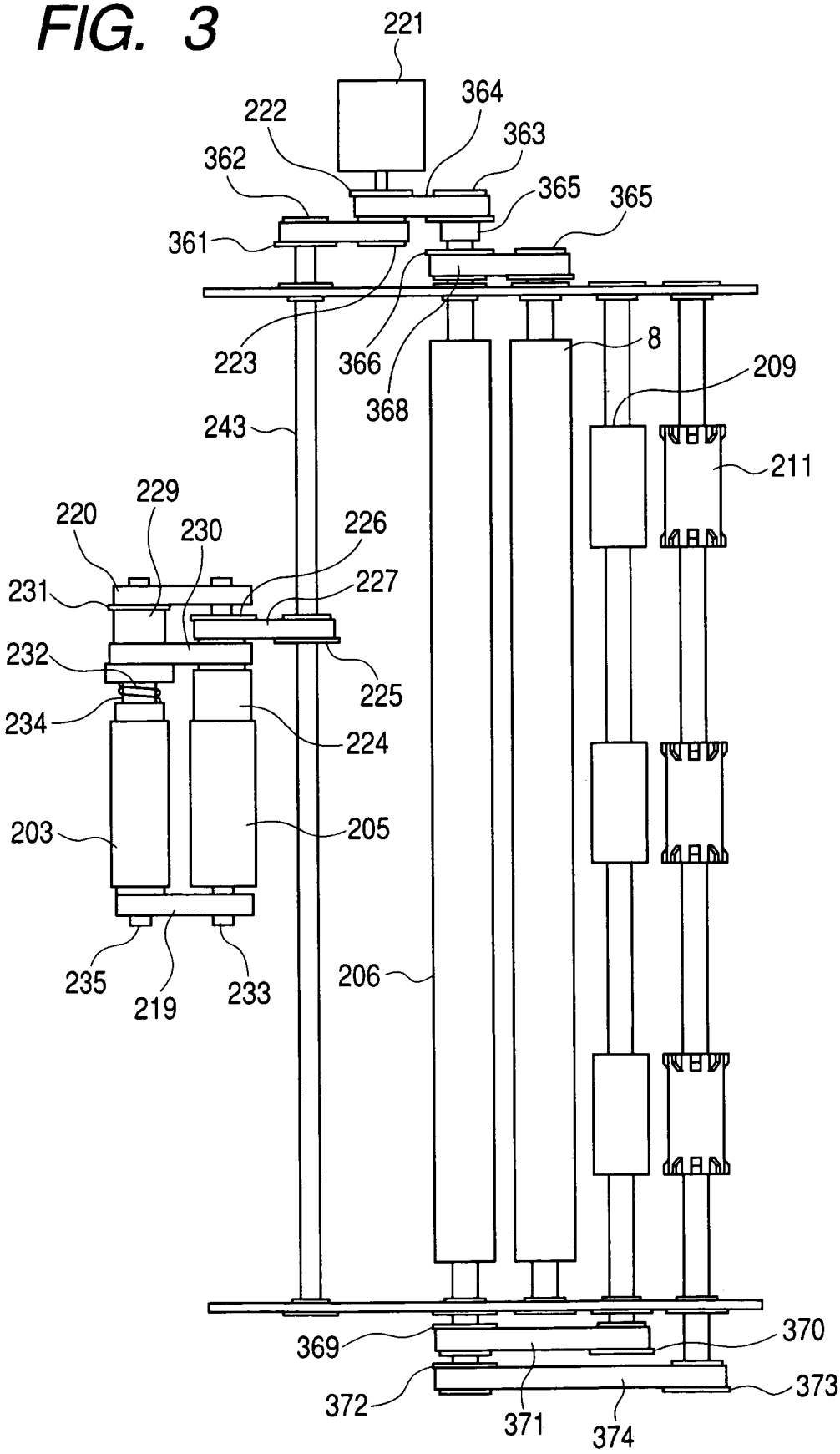
FIG. 3 is a schematic plan view of a document feeding portion in the first embodiment.

As shown in FIG. 3, the respective rollers are designed such that drive is transmitted thereto by a gear train or a timing belt. The pulley 223 of a drive motor 221 is connected to a pulley 361 on a sheet feed driving shaft 243 which is the center of pivotal movement of an openable and closable cover 251 (see FIG. 2) through a timing belt 362. A pulley 225 disposed on the shaft of the sheet feed driving shaft 243 is connected to a pulley 226 disposed on a separating roller shaft 233 through a timing belt 227.

The pulley 226 is connected to a pulley 229 disposed on a pickup roller shaft 235 through a timing belt 230. The rotational force of the pulley 226 is transmitted to the separating roller 205 through a one-way clutch 224, and is adapted to be transmitted in a counter-clockwise direction, but not in a clockwise direction, as viewed in FIG. 2. The rotational force of the pulley 229 is adapted to be transmitted to the pickup roller 203 through a coupling portion 232. The sheet feeding arm (this side) 219 and the sheet feeding arm (the inner part) 220 support the separating roller shaft 233 and the pickup roller shaft 235, and the pickup roller 203 is pivotally movable about the separating roller shaft 233. Also, a frictional member 231 is provided on the pickup roller shaft 235 and between the pulley 229 and the sheet feeding arm (the inner part) 220, and is biased toward the sheet feeding arm (the inner part) 220 by a pressure spring 234.

Accordingly, when the pulley 229 is rotated in the counter-clockwise direction from the pulley 226 through the timing belt 230, the pickup roller 203 is rotated in the counter-clockwise direction (a downward direction as viewed in FIG. 2) about the separating roller shaft 233 by the sliding load of the frictional member 231. When conversely, the pulley 226 is rotated in the clockwise direction, the pickup roller 203 is rotated in the clockwise direction (an upward direction as viewed in FIG. 2) about the separating roller shaft 233.

Description will now be made of a driving system for the register roller 206, the platen roller 8, the transport roller 209 and the discharge roller 211. The rotational force of the drive motor 221 is adapted to be transmitted from a pulley 226 to a pulley 363 through a timing belt 364. A one-way clutch 365 is connected to the pulley 363. This one-way clutch 365 is adapted to transmit the rotational force of the drive motor 221 only in a direction opposite to the direction of rotation of the separating roller 205 to the register roller 206.

Accordingly, during the forward rotation of the drive motor 221, in FIG. 2, the rotational force thereof is transmitted to the separating roller 205, which is thus rotated in the counter-clockwise direction, but the rotational force is not transmitted to the register roller 206. Also, during the reverse rotation of the drive motor 221, in FIG. 2, the rotational force thereof is not transmitted to the separating roller 205, but yet a clockwise rotational force is transmitted to the register roller 206.

A pulley 366 on the shaft of the register roller 206 is adapted to transmit the rotational force to a pulley 365 on the shaft of the platen roller 8 through a timing belt 368. Also, pulleys 369 and 372 provided on the shaft of the register roller 206 are adapted to rotate a pulley 370 and a pulley 373 through timing belts 371 and 374 to thereby rotate the transport roller 209 and the discharge roller 211, respectively.

(Construction of the Hinge Portion of the Image Reading Portion B and the Document Feeding Portion F, Construction of the Document Feeding Portion F, and Construction of the Platen Roller)

Figure 4:
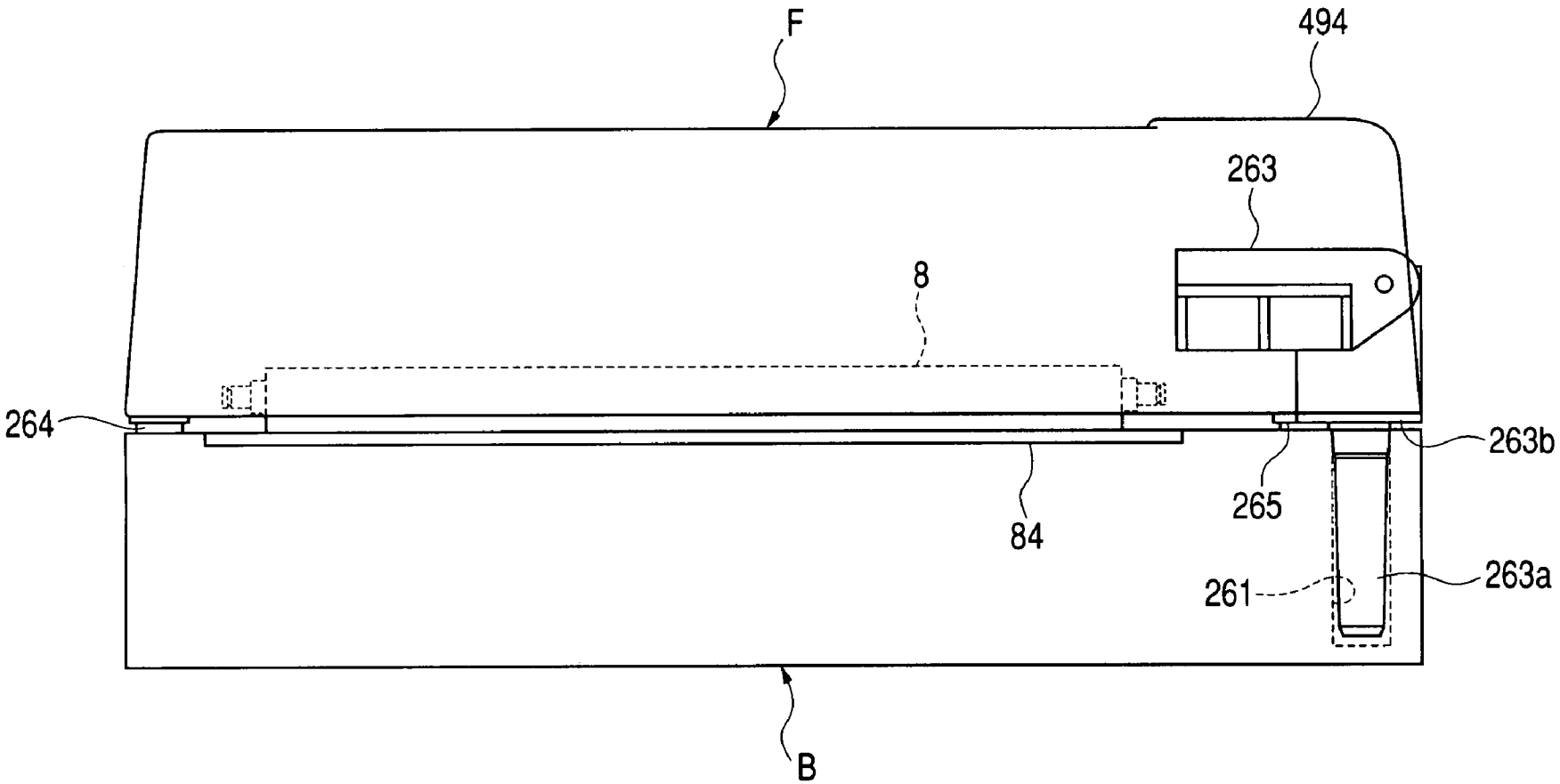
FIG. 4 is a right side view of an image reading portion and the document feeding portion when the document feeding portion is closed in the image reading apparatus of FIG. 2.
Figure 5:
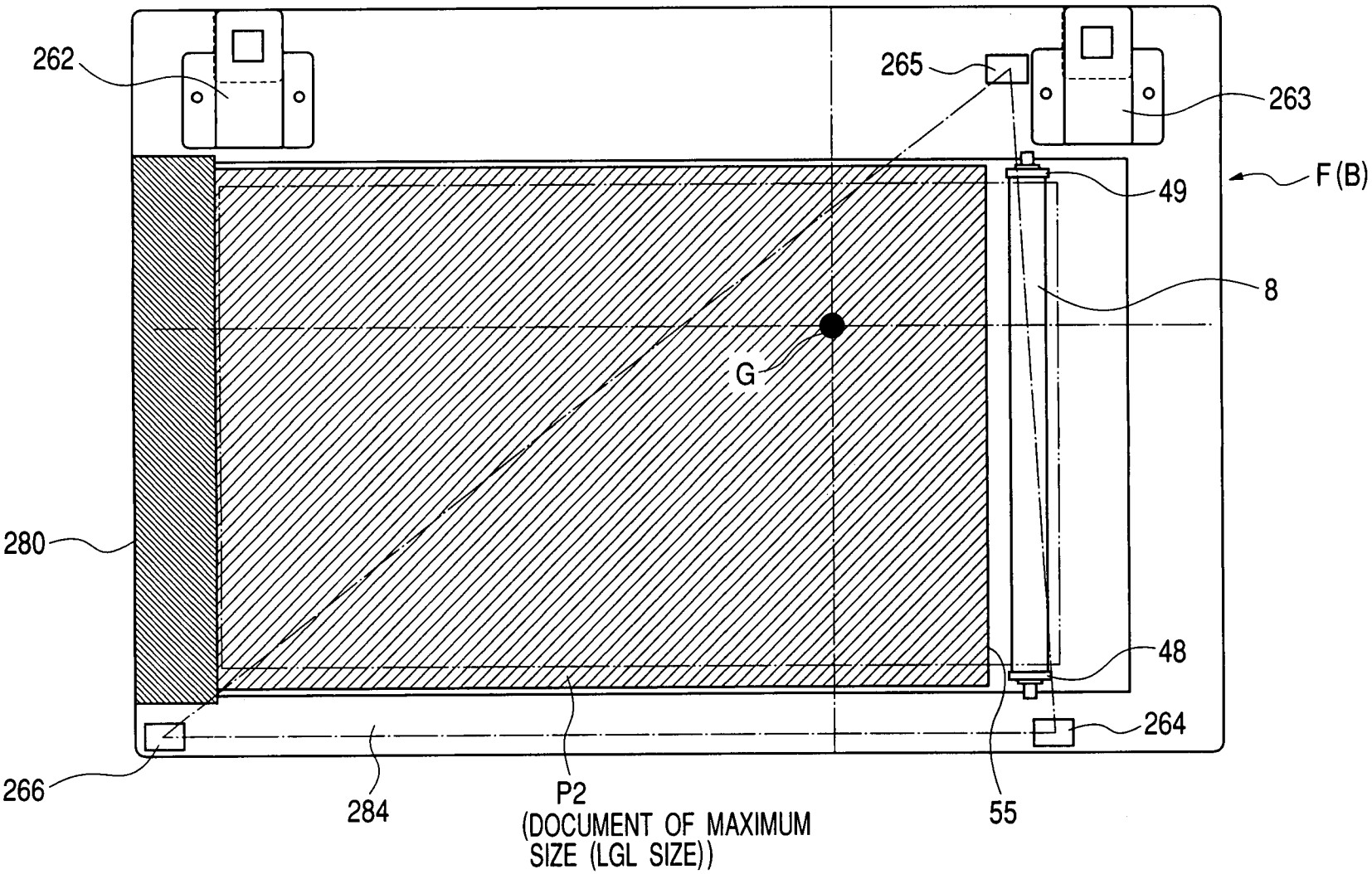
FIG. 5 is a plan view of the image reading portion and the document feeding portion of the image reading apparatus according to the first embodiment.

FIG. 5 is a top cross-sectional view of the image reading portion B and the document feeding portion F. As shown in FIG. 5, a hinge designated by the reference numeral 262 is provided leftwardly rearwardly of the image reading portion B and the document feeding portion F. A hinge denoted by the reference numeral 263 is provided rightwardly rearwardly of the image reading portion B and the document feeding portion F. In FIG. 4, design is made such that the foot portions 262*a* and 263*a* (262*a* being of the same construction as 263*a* and being not shown) of the left and right hinges are inserted into fitting holes 261 provided in the image reading portion B, whereby the horizontal position of the document feeding portion F relative to the image reading portion B is determined.

Also, the left and right hinge portions 262*a* and 263*a* are vertically movable relative to the fitting holes 261 provided in the image reading portion B, and can upwardly escape (can equalize) when during the fixed-reading mode, a thick document is placed on the document glass stand 84 and the document feeding portion F is closed.

As shown in FIG. 5, rubber feet 264, 265 and 266 which are grounded portions to the image reading portion B are provided at two locations on this side and the back side of the platen roller 8 and on the leftward this side of the document feeding portion F so that the centroid G of the document feeding portion F may be in a triangle formed by linking three points, i.e., the grounded portions.

Figure 6:
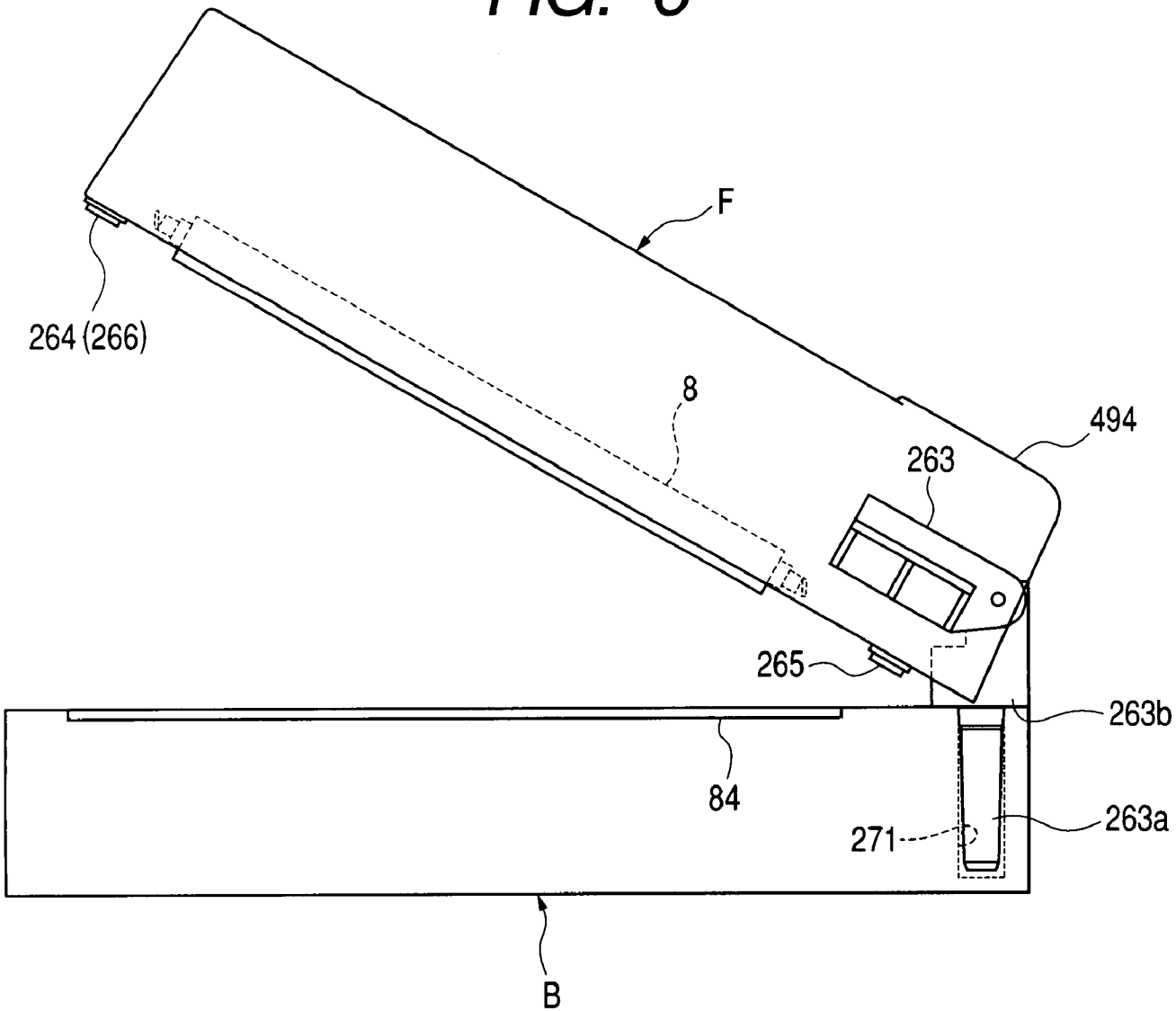
FIG. 6 is a right side view of the image reading portion and the document feeding portion when the document feeding portion is opened in the image reading apparatus according to the first embodiment.

Here, in a state as shown in FIG. 6 wherein the document feeding portion F is opened, the receiving surfaces 262*b* and 263*b* (262*b* being of the same construction as 263*b* and being not shown) of the left and right hinges 262 and 263 contact with (hereinafter referred to as "are installed on") the image reading portion B and support the document feeding portion F, but in a state as shown in FIG. 4 wherein the document feeding portion F is closed, the grounded portions which are the rubber feet 264, 265 and 266 are installed on the image reading portion B and therefore, the left and right hinge feet 262*a* and 263*a* equalize upwardly so that the receiving surfaces 262*b* and 263*b* of the left and right hinges 262 and 263 may separate from the image reading portion B.

Figure 7:
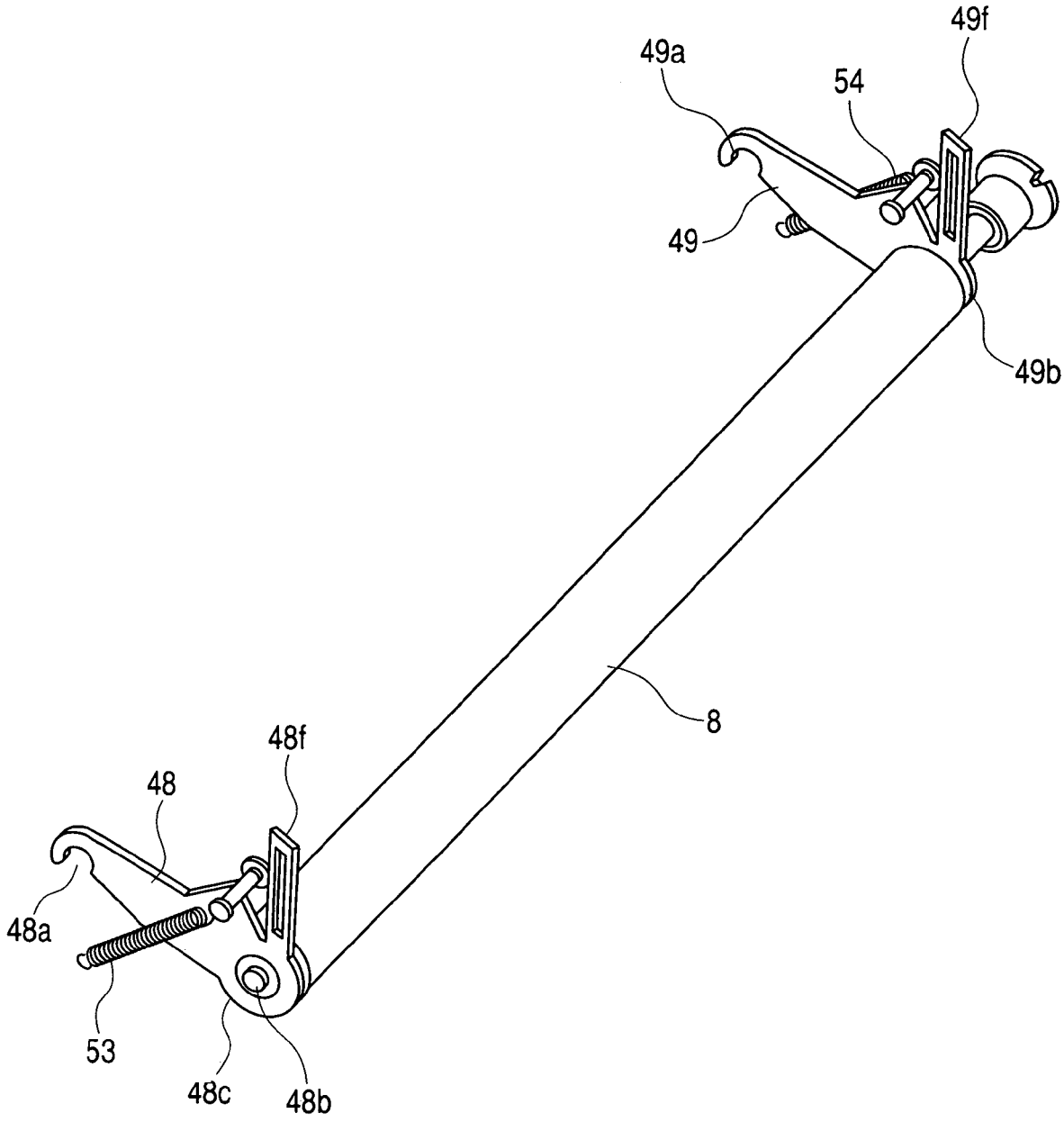
FIG. 7 is a perspective view of a platen roller in the image reading apparatus according to the first embodiment.

As shown in FIG. 7, the platen roller 8 has its front and rear ends mounted on pivotally movable arms 48 and 49, respectively, so as to be rotated about the bearing portions 48*b* and 49*b* of the front and rear pivotally movable arms 48 and 49. The front and rear pivotally movable arms 48 and 49 are pivotally movable about bearing portions 48*a* and 49*a*, respectively, and the front and rear ends of the platen roller 8 are adapted to be independently pivotally moved with the pivotally movable arms 48 and 49. Also, design is made such that the lowermost portions 48*c* and 49*c* (not shown) of the front and rear pivotally movable arms 48 and 49, respectively, are reliably installed on the document glass stand 84, for example, by biasing springs 53 and 54 which are biasing members secured to the front and rear pivotally movable arms 48 and 49, respectively.

Also, as shown in FIG. 2, the document feeding portion F has a pressure plate 55 which is a presser member for pressing the document on the document glass stand 84 during the fixed-reading mode. The pressure plate 55 is comprised of an overlying elastic member 55*a* such as a sponge and an underlying white sheet portion 55*b* stuck on each other. When the document feeding portion F is closed, the white sheet portion 55*b* is installed on the document on the document glass stand 84, whereafter the elastic member 55*a* is compressed until the rubber feet 264, 265 and 266 are installed on the image reading portion B. Accordingly, the document on the document glass stand 84 is reliably pressed against the document glass stand 84 by the pressure plate 55 so as not to move from its placed position.

As described above, the centroid G of the document feeding portion F lies in the triangle formed by linking the three points, i.e., the grounded portions of the rubber feet 264, 265 and 266 together and therefore, the document feeding portion F is such that in its closed state, the contacting portions of the rubber feet 264, 265 and 266 are reliably installed on the image reading portion B from gravity. The document feeding portion F can always be mounted at a predetermined position relative to the image reading portion B. Therefore, it never happens that the pressure plate 55 floats, and during the fixed-reading mode, it never happens that external light due to the floating of the pressure plate 55 and a shadow by a fogged image occur.

Also, the platen roller 8 has its front and rear ends adapted to be independently installed on the document glass stand 84 by the pivotally movable arms 48 and 49 and therefore, even if the installed state of the document feeding portion F somewhat differs due to a dimensional error between respective mechanisms, the document feeding portion F can be installed in a constant state on the document glass stand 84 in the reading portion and thus, reading can be reliably accomplished without the occurrence of a fogged image which would otherwise be caused by the platen roller 8 floating from the document glass stand 84 more than a predetermined amount.

In the above-described image forming apparatus 400 shown in FIG. 1, the reading position D is disposed on the right of the image reading portion B. Accordingly, the image forming apparatus 400 permits the abutment portion 280 to be disposed at the left end without an index 118 being disposed between the reading position during the flow-reading mode and the reading position during the fixed-reading mode and therefore, is adapted to enable the document glass stand 84 to be small.

Also, the image forming apparatus 400, as shown in FIG. 5, further downsizes the document glass stand 84 to thereby achieve the downsizing of the image reading portion B, in such a manner that during the fixed-reading mode, the platen roller 8 presses the trailing edge of a document of a maximum size (in the present embodiment, LGL size). Even if design is made such that the trailing edge of the LGL document P2 (the document of the maximum size) is pressed not by the pressure plate 55, but by the platen roller 8, the platen roller 8 is pressed against the document glass stand 84 and therefore, the floating of the trailing edge of the LGL document is prevented and a fogged image does not occur, and the reading of the document can be accomplished reliably.

(Characteristic Portion of the Image Reading Apparatus K According to the First Embodiment)

As shown in FIGS. 2 and 7, the platen roller 8 is pivotally moved about the bearing portions 48*a* and 49*a* by the front and rear pivotally movable arms 48 and 49. Also, plungers 56 and 56 (one of which is not shown) for upwardly pulling the pivotally movable arms 48 and 49 are connected to connecting portions 48*f* and 49*f*. While in FIG. 2, the plunger 56 protrudes from the discharge tray 18, it is shown so to exergerate, and actually it does not protrude.

In a state in which the document feeding portion F is opened, the plungers 56 pull up the pivotally movable arms 48 and 49 (solid-line position in FIG. 2) by the signal of an opening-closing detecting sensor S. That is, when a control portion J receives a signal for detecting that the document feeding portion F has been opened by the opening-closing detecting sensor S, a control portion C controls the plungers 56 so as to pull up the pivotally movable arms 48 and 49. In a state in which the plungers 56 have pulled up the pivotally movable arms 48 and 49, lower one of the lowermost points 48*c* and 49*c* of the pivotally movable arms 48 and 49 and the lowermost point of the platen roller 8 is located at a distance H above the underside of the white sheet portion 55*b*.

When the document feeding portion F is closed with the pivotally movable arms 48 and 49 remaining pulled up, the white sheet portion 55*b* contacts with the document earlier and presses the document against the document glass stand 84. Therefore, the document on the document glass stand 84 does not positionally deviate, but is reliably pressed against the document glass stand 84.

When here, a start button, not shown, is depressed, the plungers 56 stop suction and the pivotally movable arms 48 and 49 are pivotally moved by biasing springs 53 and 54, respectively, and the platen roller 8 presses the trailing edge of the document on the document glass stand 84. Thereafter, the image of the document placed on the document glass stand 84 is read by a reading sensor 283.

As described above, the document is pressed against the document glass stand 84 by the pressure plate 55 before the pivotally movable arms 48, 49 and the platen roller 8 contact with the document (of the maximum size) placed on the document glass stand 84 and therefore, the positional deviation of the placed document can be prevented.

That is, in the image reading apparatus K according to the present embodiment, when the document feeding portion F is opened, the pivotally movable arms 48 and 49 are pulled up to above the underside of the white sheet portion 55*b* of the pressure plate 55 by the plungers 56. Thereafter, the document feeding portion F is closed and the document is pressed against the document glass stand 84 by the pressure plate 55, whereafter the suction by the plungers 56 is stopped, and the trailing edge of the document (document of the maximum size) is adapted to be pressed against the document glass stand 84 by the platen roller 8 and therefore, the positional deviation of the document relative to the document glass stand 84 can be prevented and the document can be pressed against the document glass stand 84 and thus, image reading can be accomplished reliably.

In the above-described embodiment, description has been made of a construction in which the pivotally movable arms 48 and 49 are pulled up by the plungers 56 when it is detected by the opening-closing detecting sensor S that the document feeding portion F has been opened. As another form, provision may be made of a size detecting sensor H for detecting the size of the document placed on the document glass stand 84 when the opening angle of the document feeding portion F has become a predetermined angle so that the plungers 56 may pull up the pivotally movable arms 48 and 49 only when the size of the document detected by the size detecting sensor H is large. The size detecting sensor detects whether the document placed on the document glass stand 84 is of such a size that in a state in which one end of the document is abutted against the abutment portion 280 and positioned, the other end of the document is located immediately below the platen roller 8. In this case, the size of the document on the document glass stand 84 is detected when the opening angle of the document feeding portion F has become a predetermined angle when a user closes the document feeding portion F. When the document is a large document, the pulling-up of the pivotally movable arms 48 and 49 by the plungers 56 is effected. Thereafter, a copy button is depressed to thereby stop the pulling-up by the plungers 56, and the document is pressed by the platen roller 8. It is no longer practiced to effect the pulling-up of the pivotally movable arms 48 and 49 by the plungers 56 each time the document feeding portion F is opened and closed and therefore, the life of the plungers 56 becomes longer.

Characteristic Portion of the Image Reading Apparatus M According to the Second Embodiment The image reading apparatus M according to the second embodiment of the present invention will now be described with reference to FIG. 8.

Portions of the image reading apparatus M which differ from those of the image reading apparatus K according to the first embodiment will hereinafter be chiefly described and the constructions of the other portions need not be described.

Figure 8:
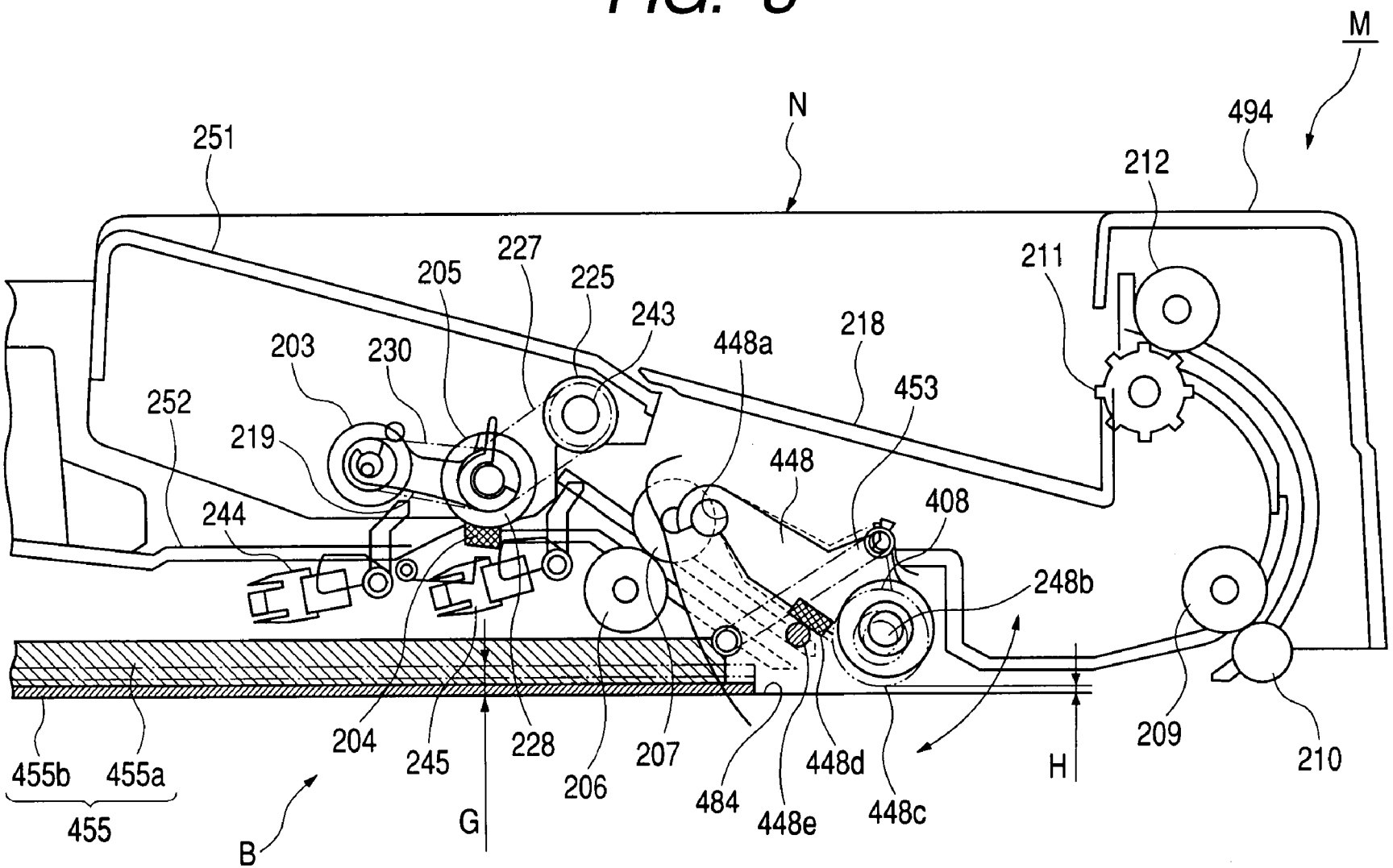
FIG. 8 is a cross-sectional view of an image reading apparatus according to a second embodiment of the present invention taken along a document transport direction.
Figure 9:
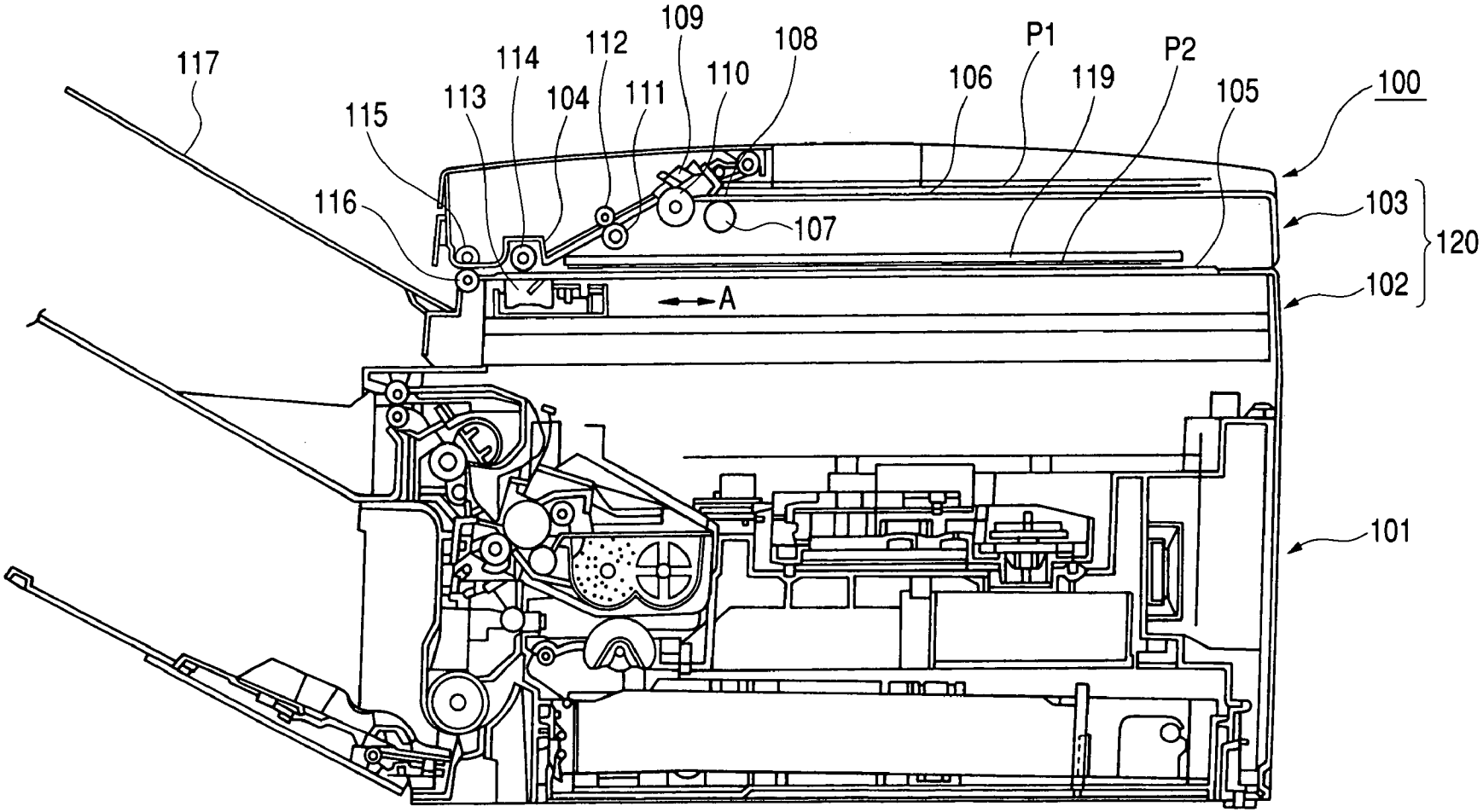
FIG. 9 is a cross-sectional view of an image forming apparatus according to a first conventional example taken along a sheet transport direction.
Figure 10:
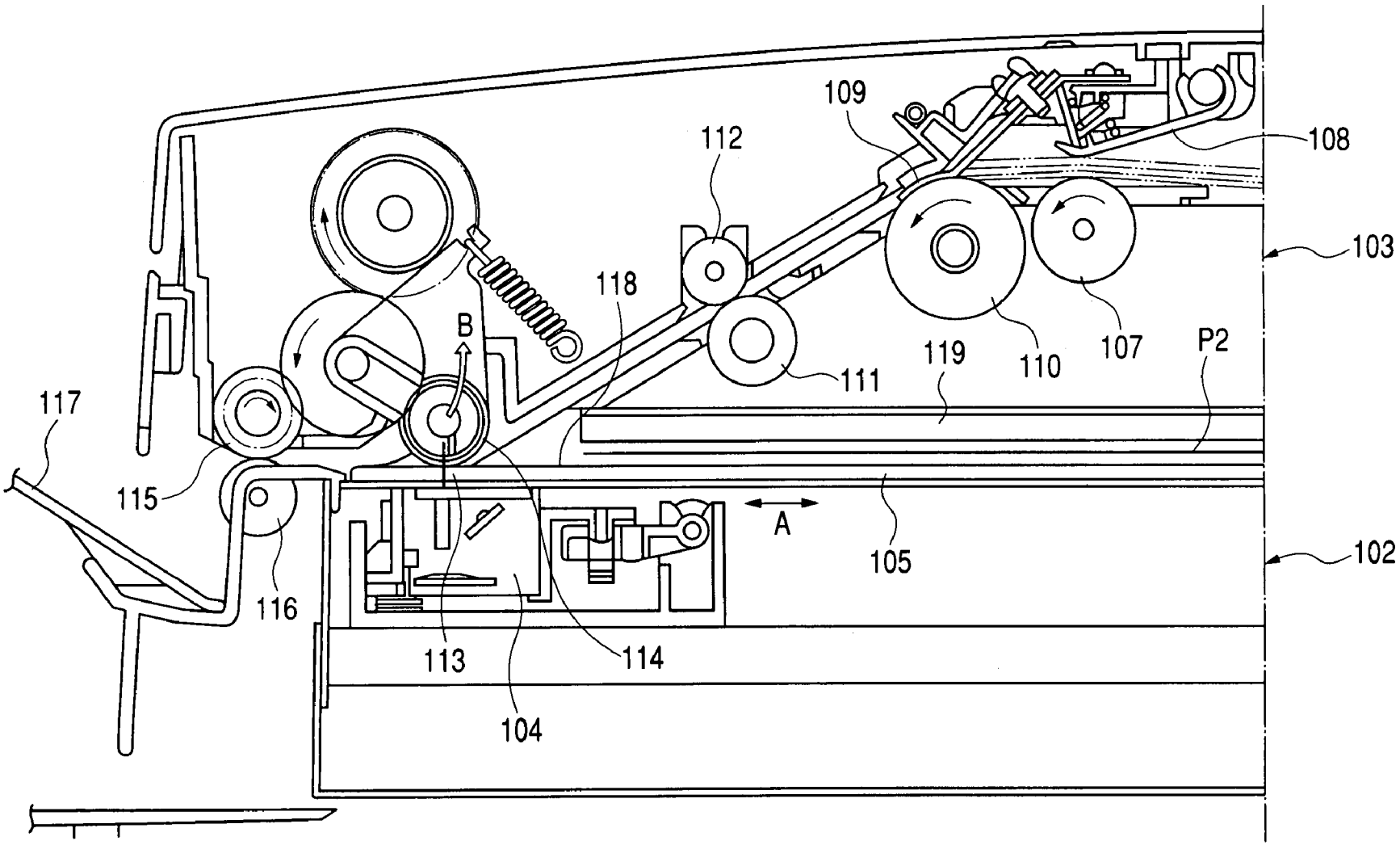
FIG. 10 is a fragmentary enlarged view of a document feeding portion and an image reading portion in the image forming apparatus of FIG. 9.
Figure 11:
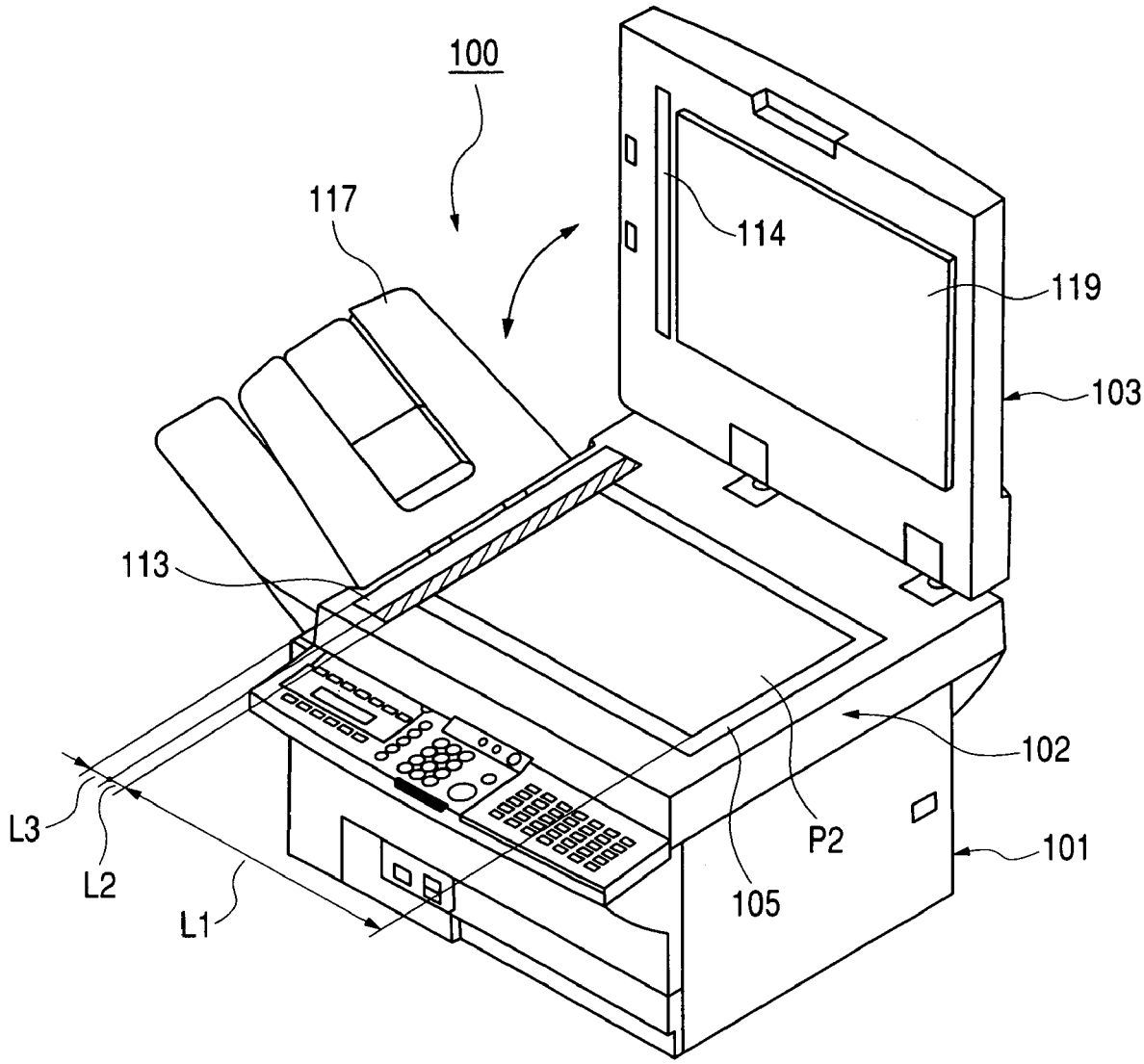
FIG. 11 is a perspective view showing a state in which the document feeding portion is opened in the image reading apparatus of FIG. 9.
Figure 12:
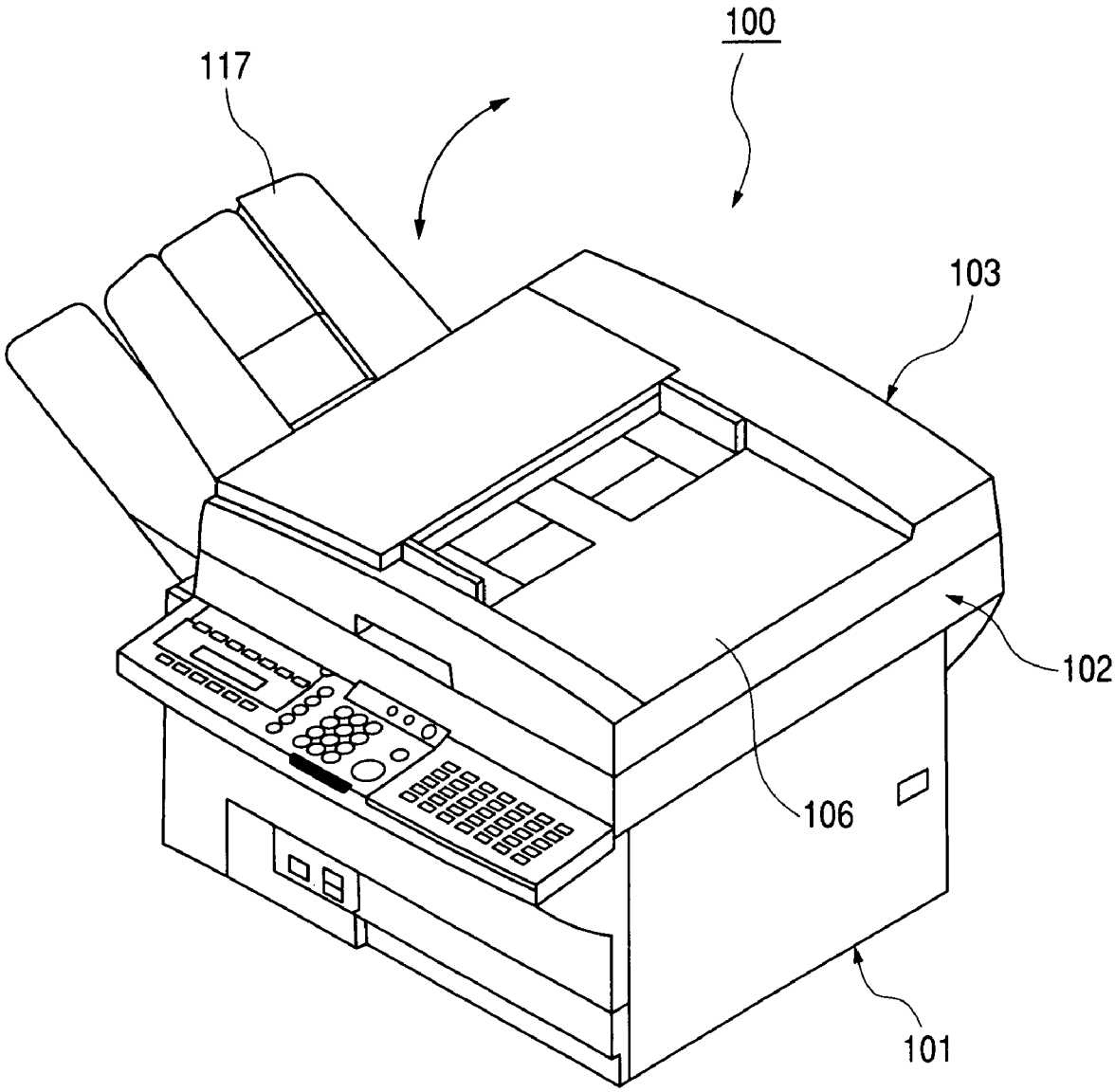
FIG. 12 is a pictorial perspective view of the image forming apparatus of FIG. 9.
Figure 13:
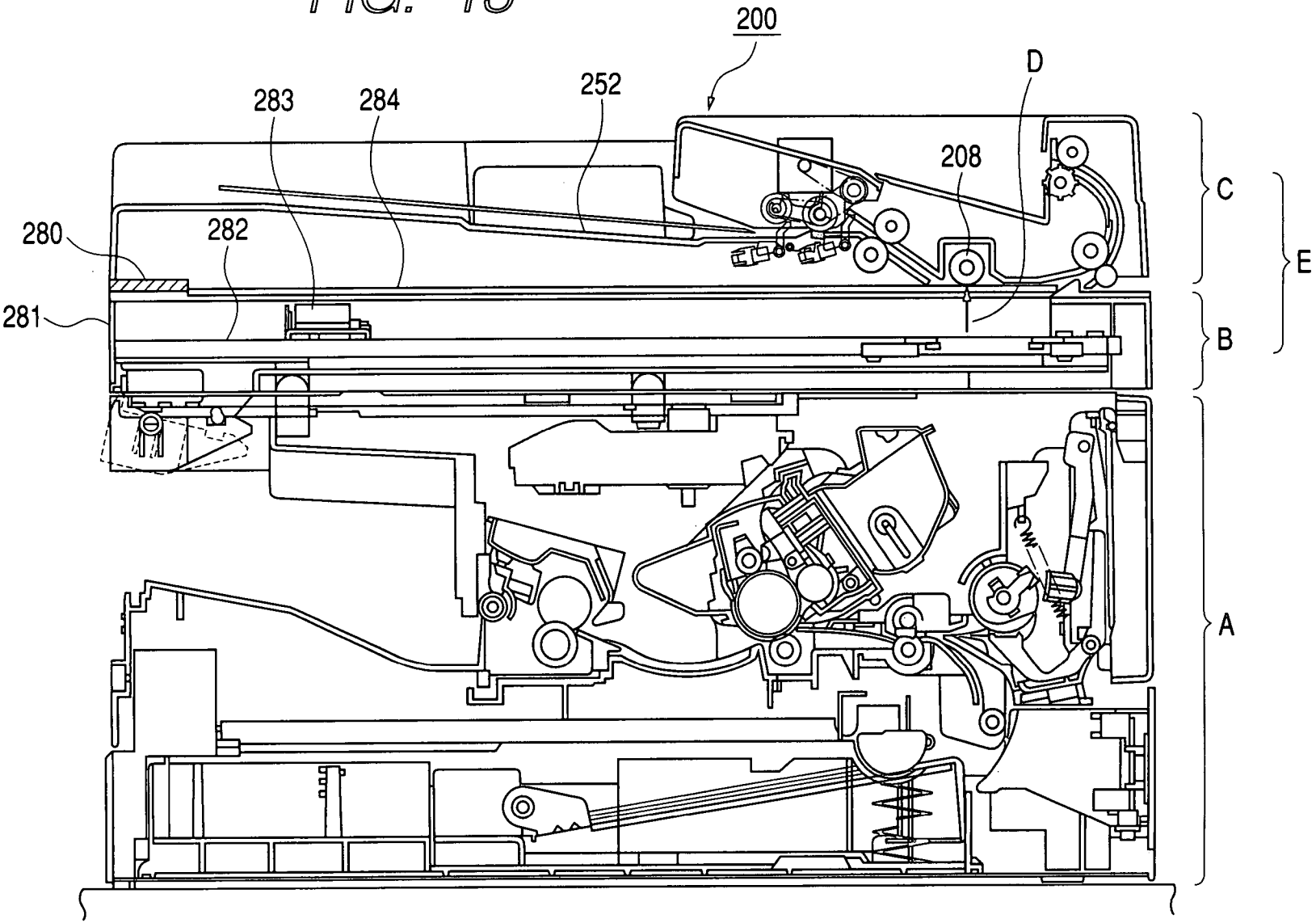
FIG. 13 is a cross-sectional view of an image forming apparatus according to a second conventional example taken along a sheet transport direction.
Figure 14:
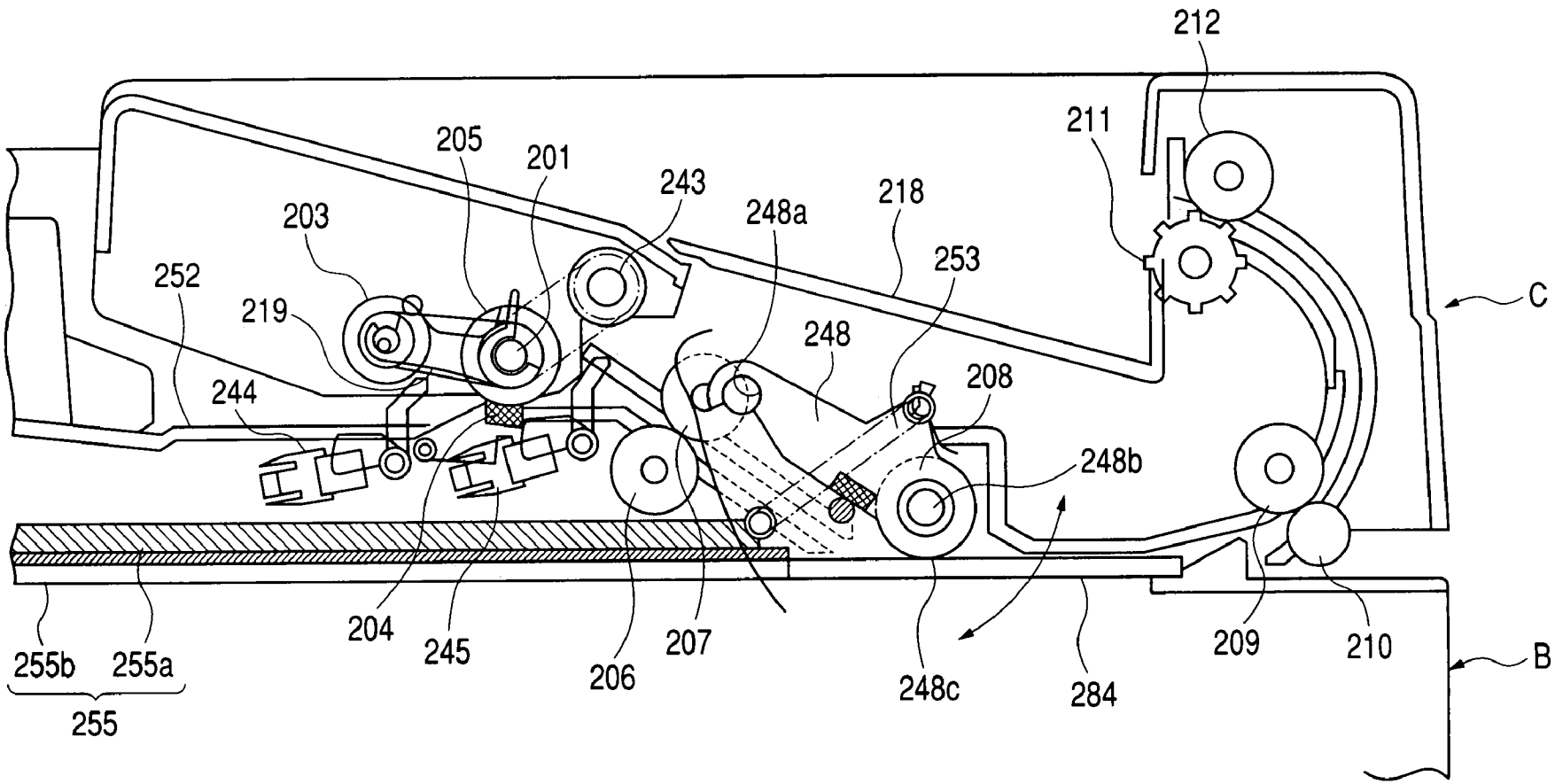
FIG. 14 is a cross-sectional view of the document feeding apparatus of the image forming apparatus of FIG. 13 taken along a document transport direction.
Figure 15:
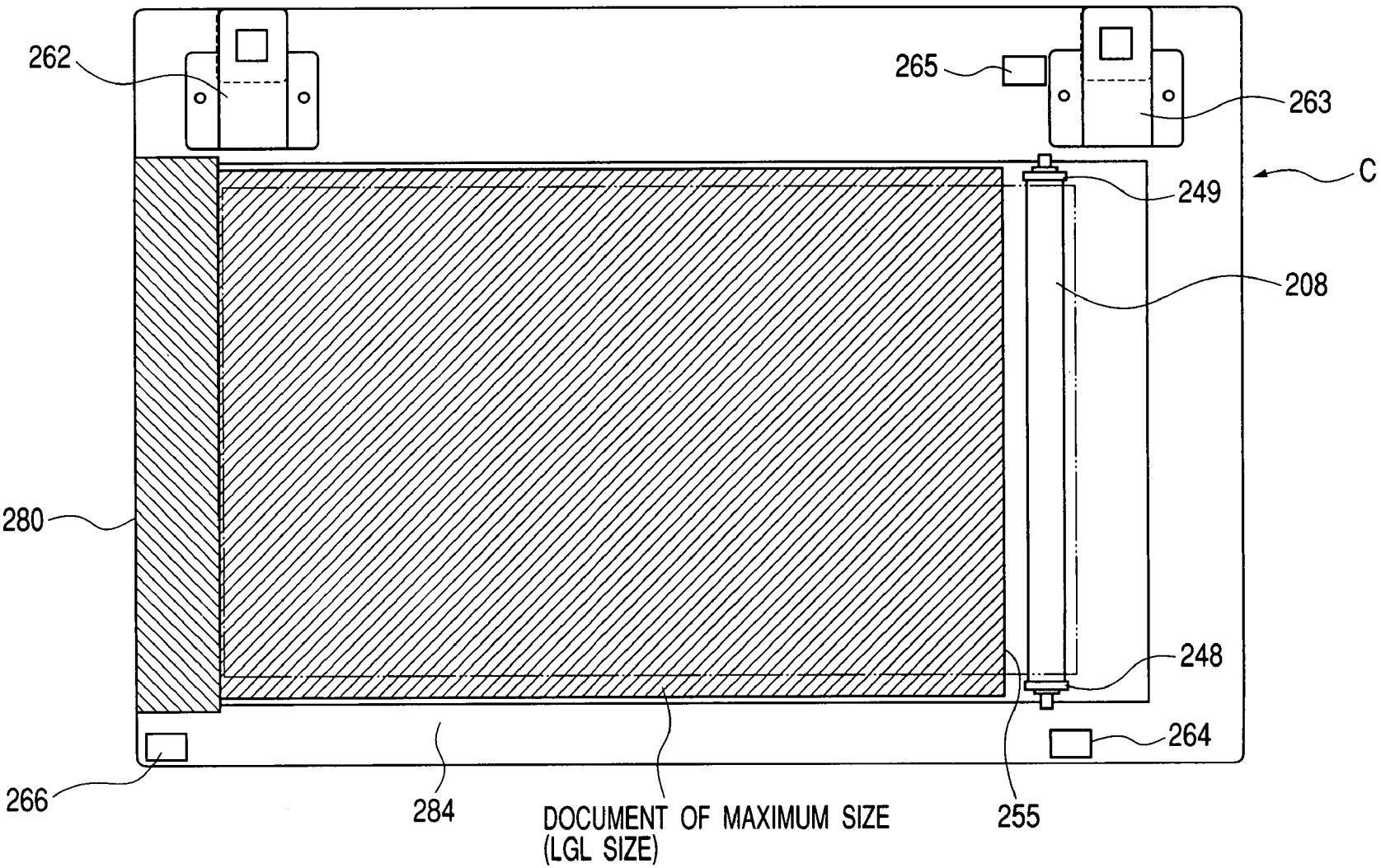
FIG. 15 is a plan view of the image reading portion and the document feeding portion of the image reading apparatus of FIG. 13.
Figure 16:
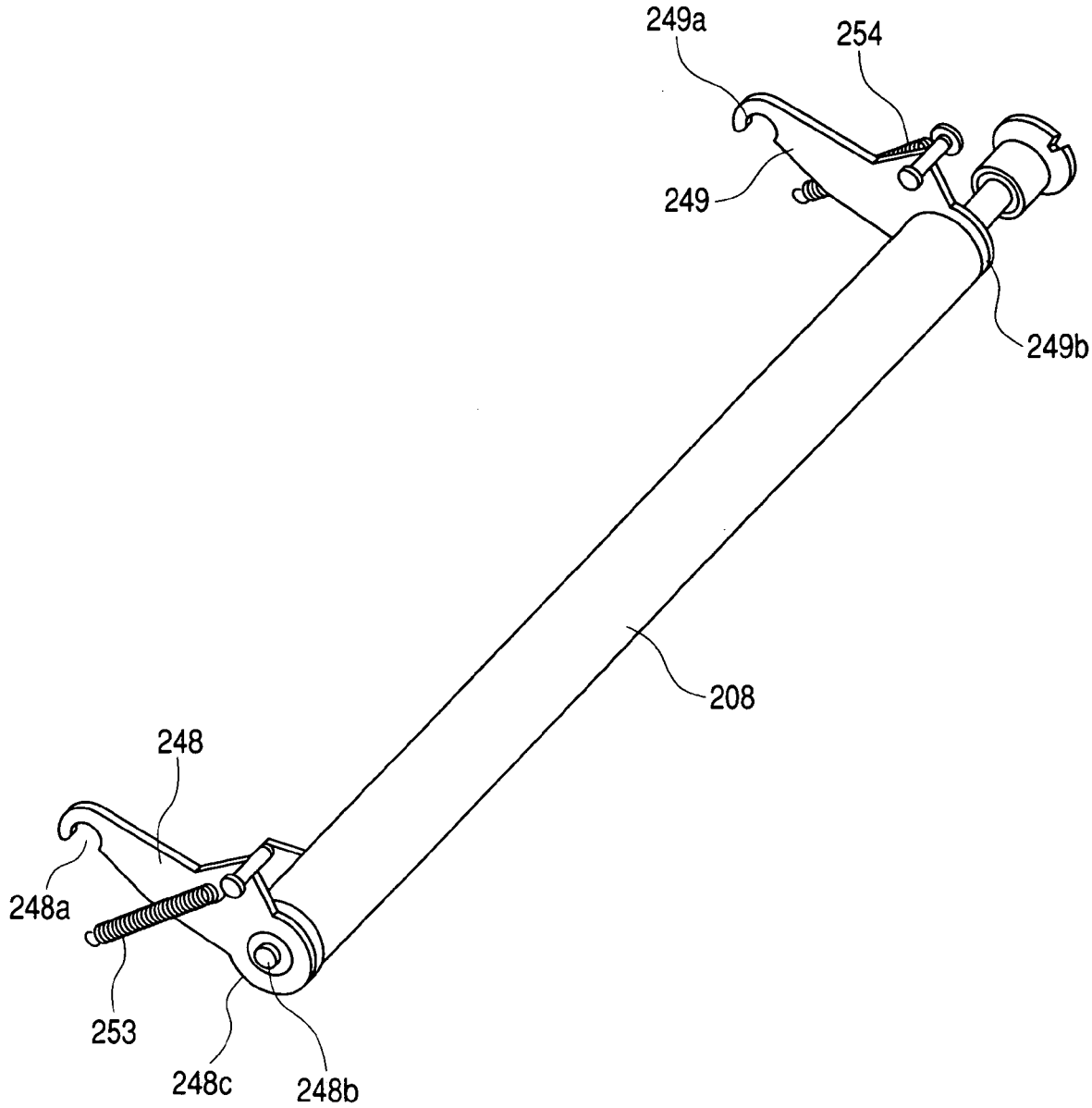
FIG. 16 is a perspective view of a platen roller in the image reading apparatus of FIG. 13.
Figure 17:
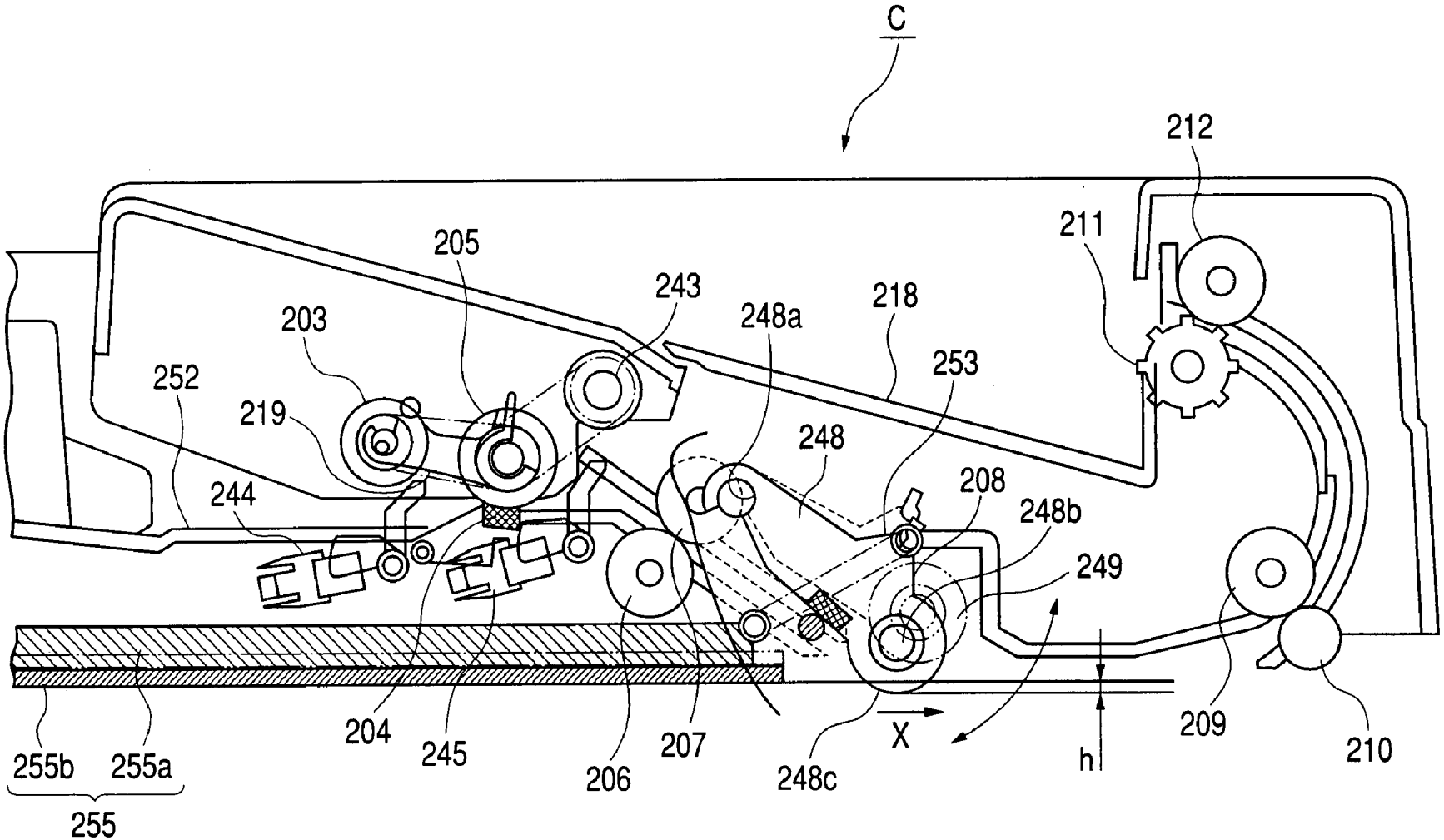
FIG. 17 is a cross-sectional view of the document feeding apparatus in the image reading apparatus of FIG. 13 taken along the document transport direction.
Figure 18:
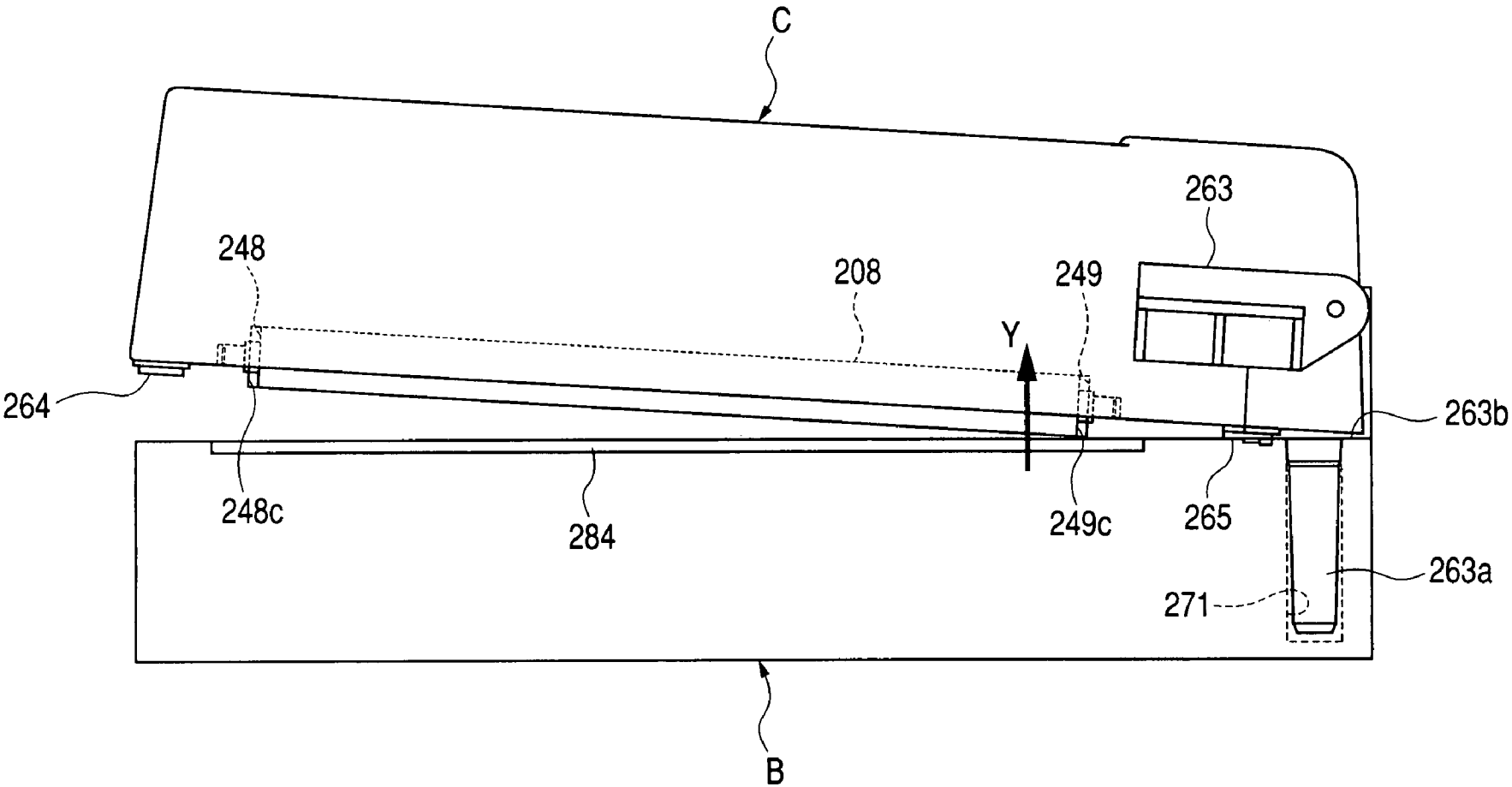
FIG. 18 is a cross-sectional view of the document feeding apparatus of the image reading apparatus of FIG. 13 during the contact thereof with a document glass stand taken along the platen roller.
Figure 19:
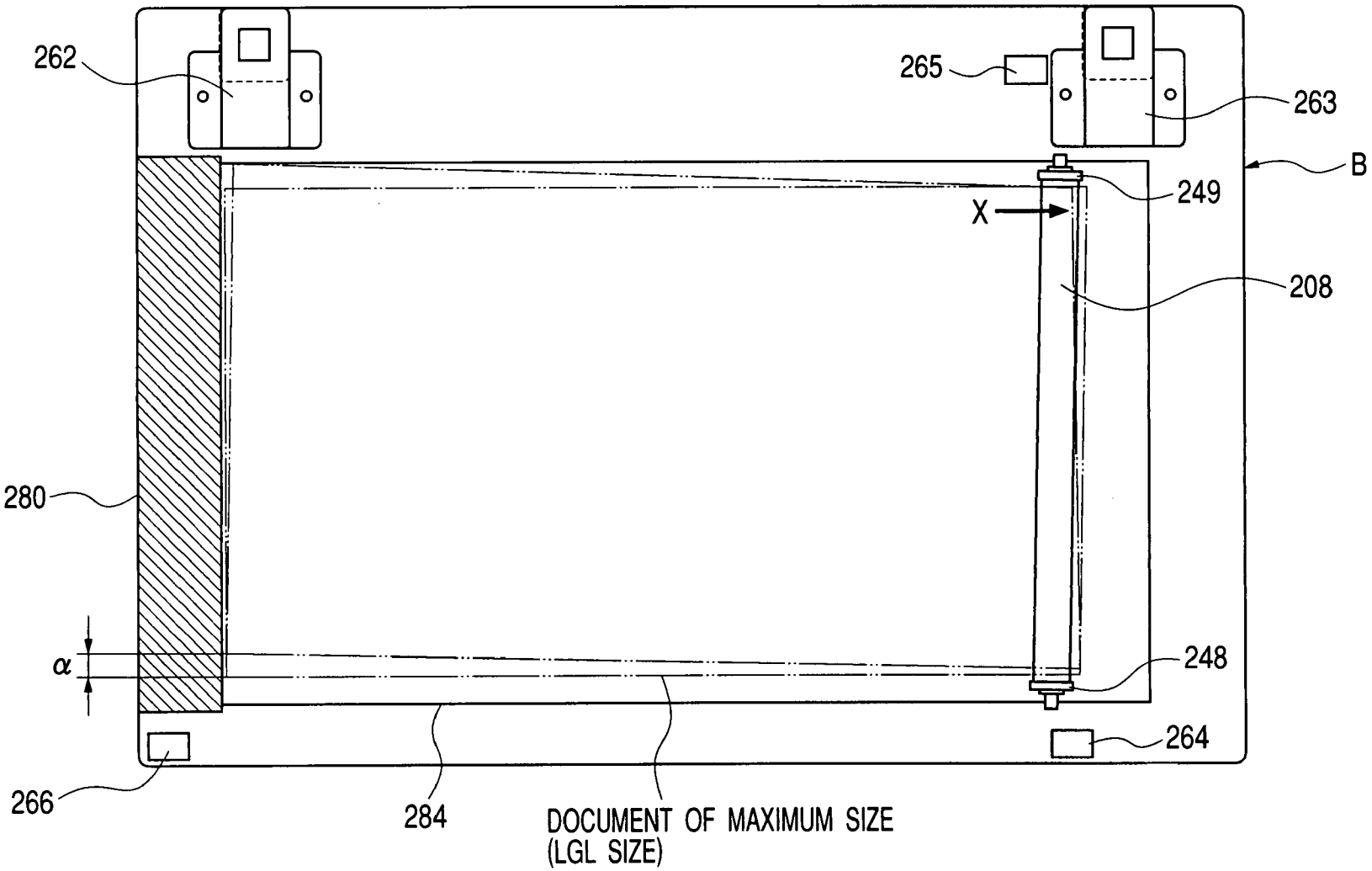
FIG. 19 is a plan view of an image reading portion and a document feeding portion during the contact of the document feeding portion of the image reading apparatus of FIG. 13 with the document glass stand.

As shown in FIG. 8, a platen roller 408 is pivotally moved about bearing portions 448*a* and 449*a* by front and rear pivotally movable arms 448 and 449 (the inner side pivotally movable arm 449 and portions regarding this arm 449 are similar in construction to the front side pivotally movable arm 448 and are therefore not shown). In a state in which for example, a document feeding portion N which is a sheet feeding portion is closed, the lowermost portions 448*c* and 449*c* of the pivotally movable arms 448 and 449, respectively, contact with a document glass stand 484 and therefore, the pivotally movable arms 448 and 449 are moved up to their broken-line positions in FIG. 8. In a state in which the document feeding portion N is opened, the pivotally movable arms 448 and 449 are pulled down, for example, by biasing springs 453 and 454 (the inner side biasing spring being the same as the front side biasing spring 453 and being not shown) which are biasing members. So, abutment portions 448*d* and 449*d* provided on the pivotally movable arms 448 and 449, respectively, and for example, stopper portions 448*e* and 449*e* which are protrusions provided on a frame side come into contact with each other. The stopper portions 448*e* and 449*e* regulate the pivotally movable arm 448 being clockwisely pivotally moved by a predetermined amount or greater. The stopper portions 448*e*, 449*e* and the biasing springs 453, 454 together constitute the positioning means of the present invention for determining the position of the platen roller 408 when the document feeding portion N is opened.

The stopper portion 448*e* is disposed so that when the pivotal movement of the pivotally movable arm 448 is regulated by the stopper portions 448*e* and 449*e*, lower one of the lowermost portion of the platen roller 408 and the lowermost portions 448*c* and 449*c* of the pivotally movable arms 448 and 449 may be located higher by an amount corresponding to a distance H relative to the white sheet portion 455*b* of a pressure plate 455. Also, when the document feeding portion N has been closed, the platen roller 408 must reliably contact with the document glass stand 484 when an elastic member 455*a* is crushed until the white sheet portion 455*b* of the pressure plate 455 assumes the dots-and-dash line position of FIG. 8. Accordingly, the stopper portions 448*e* and 449*e* are disposed so that the relation between the amount of crush G of the pressure plate 455 and the distance H may be G>H>0.

Thereby, when the document feeding portion N is closed, the white sheet portion 455*b* contacts with a document earlier and presses the document, whereby the placed document (of the maximum size) can be prevented from being deviated against the pivotal movement of the pivotally movable arms 448 and 449, and in a state in which the document feeding portion N is closed, the platen roller 408 can reliably press the document on the document glass stand 484.

That is, in the image reading apparatus M according to the present embodiment, provision is made of the stopper portion 448*e* and 449*e* for regulating the amounts of rotation (the amounts of pivotal movement) of the pivotally movable arms 448 and 449 for pivotally moving the platen roller 408 so that in a state in which the frame 494 of the document feeding portion N is opened, the undersides of the pivotally movable arms 448 and 449 may be higher than the underside of the white sheet portion 455*b* of the pressure plate 455. When the document feeding portion N has been closed, the white sheet portion 455*b* presses the placed document earlier than the platen roller 408, whereby the trailing edge of the document of the maximum size can be prevented from being positionally deviated by the pivotal movement of the platen roller 408, and image reading during fixed-reading can be accomplished reliably. Also, expensive electrical parts such as the plungers 56 are not used and therefore, the above-described effect can be achieved by an inexpensive apparatus construction.

What is claimed is:

1. An image reading apparatus comprising:

a reading glass member on which a document is positioned;

a reading unit, which reads the document placed on said reading glass member while being moved below said reading glass member in a first reading mode, and which reads the document fed past a reading position while said reading unit is stopped at said reading position in a second reading mode, a plate-like presser member configured to press the document against the reading glass member in the first reading mode;

a transporting rotary member configured to feed the document past said reading position of said reading glass member in the second reading mode; and an openable and closable unit which is openable and closable relative to said reading glass member, and which holds said plate-like presser member and said transporting rotary member, wherein said plate-like presser member presses the document placed on said reading glass member against said reading glass member, and said transporting rotary member presses an edge of the document, the remainder of which is pressed by said plate-like presser member, against said reading glass member, while said reading unit reads the document placed on said reading glass member in the first reading mode, and wherein said plate-like presser member presses the document placed on said reading glass member against said reading glass member by a closing operation of said openable and closable unit before said transporting rotary member presses the document against the reading glass member, and thereafter said transporting rotary member presses the document, which has been pressed against the reading glass member by the plate-like presser member, against the reading glass member.

2. An image reading apparatus according to claim 1, further comprising:

a biasing member for biasing said transporting rotary member in a direction to be brought into pressure contact with said reading glass member; and a plunger for pulling said transporting rotary member away from said reading glass member against a biasing force of said biasing member, wherein after said openable and closable unit is closed and said plate-like presser member has pressed the document against said reading glass member, a pulling by said plunger is stopped and said transporting rotary member presses the document against said reading glass member by the biasing force of said biasing member.

3. An image reading apparatus according to claim 1, further comprising:

positioning means for determining a position of said transporting rotary member when said openable and closable unit is opened, wherein after said openable and closable unit is closed and said plate-like presser member has pressed the document against said reading glass member, said positioning means positions said transporting rotary member so that said transporting rotary member may press the document against said reading glass member.

4. An image reading apparatus according to claim 3, wherein said transporting rotary member is pivotally supported, and said positioning means has a protrusion for regulating a pivotal movement of said transporting rotary member, and a biasing member for biasing said transporting rotary member toward a side of said protrusion.

5. An image reading apparatus according to claim 3, wherein said plate-like presser member has elasticity, and wherein when said plate-like presser member presses the document against said reading glass member by a closing operation of said openable and closable unit, said plate-like presser member is elastically deformed, and wherein when said transporting rotary member is positioned by said positioning means to press the document against the reading glass member, there is an elastic deformation of said plate-like presser member.

6. An image reading apparatus according to claim 1, wherein said transporting rotary member is disposed on one end side of said plate-like presser member, and an abutment portion against which an edge portion of the document placed on said reading glass member is abutted to thereby determine the position of the document is disposed on the other end side of said plate-like presser member and on a side of said reading glass member.

7. An image reading apparatus according to claim 1, wherein said transporting rotary member is a roller facing in a direction intersecting with a direction in which the document is fed, and opposite ends of said roller are supported by pivotally movable arms provided for pivotal movement relative to said openable and closable unit.

8. An image forming apparatus comprising:

an image reading apparatus according to claim 1; and image forming means for forming on a recording material an image read by said image reading apparatus.

* * * * *